US010414168B2

(12) United States Patent
Yoshida

(10) Patent No.: US 10,414,168 B2
(45) Date of Patent: Sep. 17, 2019

(54) INKJET PRINTER AND PRINTING METHOD

(71) Applicant: Roland DG Corporation, Hamamatsu-shi, Shizouka (JP)

(72) Inventor: Seishin Yoshida, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/953,610

(22) Filed: Apr. 16, 2018

(65) Prior Publication Data

US 2018/0297371 A1 Oct. 18, 2018

(30) Foreign Application Priority Data

Apr. 18, 2017 (JP) ..... 2017-082145

(51) Int. Cl.
*B41J 2/21* (2006.01)

(52) U.S. Cl.
CPC ..... *B41J 2/2132* (2013.01); *B41J 2/2117* (2013.01); *B41J 2/2121* (2013.01)

(58) Field of Classification Search
CPC ..... B41J 2/2117
See application file for complete search history.

(56) References Cited

U.S. PATENT DOCUMENTS

2011/0228023 A1* 9/2011 Ozawa ..... B41J 2/2117 347/98
2012/0001973 A1 1/2012 Sano
2012/0019579 A1* 1/2012 Usuda ..... B41J 2/2117 347/12
2013/0208035 A1 8/2013 Okumura
2013/0241988 A1 9/2013 Mills
2014/0354726 A1* 12/2014 Heath ..... B41J 2/2117 347/15
2015/0191024 A1* 7/2015 Heath ..... H04N 1/60 347/15

FOREIGN PATENT DOCUMENTS

JP 07-040539 A 2/1995
JP 2012-011752 A 1/2012
JP 2013-067031 A 4/2013
JP 2013-163343 A 8/2013
JP 2014-097671 A 5/2014

OTHER PUBLICATIONS

Yoshida, "Inkjet Printer", U.S. Appl. No. 15/953,611, filed Apr. 16, 2018.
Ogura, "Inkjet Printer", U.S. Appl. No. 15/953,613, filed Apr. 16, 2018.

* cited by examiner

*Primary Examiner* — Shelby L Fidler
(74) *Attorney, Agent, or Firm* — Keating & Bennett, LLP

(57) ABSTRACT

An inkjet printer ejects a first ink including multiple colors and a second ink. A controller generates dot groups including an underlying layer dot group and an image dot group from ink dots of the first ink of each of the colors. The dot groups of each of the colors include all of the ink dots of the corresponding color. The controller forms a first printing layer of at least the ink dots of the underlying layer dot group of each of the colors and ink dots of the second ink. The controller forms a second printing layer of at least the ink dots of the image dot group of each of the colors.

19 Claims, 13 Drawing Sheets

FIG.7

| | | RECORDING MEDIUM | | | |
|---|---|---|---|---|---|
| | | A | B | C | D |
| INK | CYAN (C) | 10% | 15% | 20% | 10% |
| | MAGENTA (M) | 10% | 15% | 20% | 10% |
| | YELLOW (Y) | 20% | 25% | 30% | 10% |
| | BLACK (K) | 10% | 15% | 20% | 10% |
| | GRAY (Lk) | 10% | 15% | 20% | 10% |
| | LIGHT CYAN (Lc) | 20% | 25% | 30% | 10% |
| | LIGHT MAGENTA (Lm) | 20% | 25% | 30% | 10% |

INKJET PRINTER AND PRINTING METHOD

CROSS REFERENCE TO RELATED APPLICATIONS

This application claims the benefit of priority to Japanese Patent Application No. 2017-082145 filed on Apr. 18, 2017. The entire contents of this application are hereby incorporated herein by reference.

BACKGROUND OF THE INVENTION

1. Field of the Invention

The present invention relates to an inkjet printer and a printing method.

2. Description of the Related Art

Conventionally, an inkjet printer for large format printing that includes a plurality of recording heads arrayed in a direction perpendicular to a scanning direction of a head unit is known. The inkjet printer having such a structure performs printing on a large area of a recording medium within a short time. Japanese Laid-Open Patent Publication No. 2013-67031 discloses an inkjet recording device including nine head units corresponding to nine colors of ink arrayed in the scanning direction. The nine head units each include nine recording heads arrayed in a feeding direction perpendicular to the scanning direction.

Some of recording mediums such as cloth, paper, and the like are not white. In the case in which process color ink is directly ejected onto such a non-white recording medium, the real color of the ink may not be provided. According to a technique for dealing with this situation, a recording head ejecting white ink is added to the printer ejecting nine colors of ink as described in Japanese Laid-Open Patent Publication No. 2013-67031, so that the printer provides 10 colors of ink. With this technique, first, the white ink is used to form a white underlying color layer on a surface of the recording medium. After the white ink layer is formed on the recording medium, an image layer of process color ink is formed on the white ink layer. In this manner, a color close to the real color of the ink is printed even on a recording medium that is not white.

Usually, the above-described technique provides a sufficiently high level of image quality even on a recording medium that is not white. However, a still higher level of image quality may be desired for some uses of the printed item. In the field of, for example, outdoor advertisements or the like, there is a need for an image giving a strong impression of having depth or massiveness in order to attract more attention. The human sense of vision perceives depth or thickness even on an image formed two-dimensionally. However, often, the conventional printing method does not allow the human sense of vision to sufficiently exert this ability. A reason for this is that the image layer is thin and, thus, the influence of special color ink forming the underlying color layer is not completely eliminated. More specifically, one reason is that the maximum amount of the process color ink that is able to be printed to form the image layer is decreased because there is a limit on the amount of ink that is able to be accepted by the recording medium. Another reason is that the color developing property of the process color ink is decreased by the process color ink being printed on the underlying color layer. For example, in the case in which the special color ink is white ink, the image appears whitish and thus lacks massiveness.

In addition, in the case in which the printing is performed in an overlapping manner as described above, the degree of influence of the special color ink varies in accordance with the color of process color ink. As a result, an image having a different color balance from that of the original image may be provided.

SUMMARY OF THE INVENTION

Preferred embodiments of the present invention provide inkjet printers that print an image with an appearance that has depth or massiveness, and printing methods using such inkjet printers.

An inkjet printer according to a preferred embodiment of the present invention includes a plurality of ink heads including a first color ink head, a second color ink head and a second ink ink head (ink head for second ink); a moving mechanism moving the plurality of ink heads and a recording medium with respect to each other; and a controller connected with the plurality of ink heads and the moving mechanism that controls the plurality of ink heads and the moving mechanism. The first color ink head includes a plurality of nozzles through which first ink of a first color is ejected towards the recording medium to form ink dots of the first ink of the first color on the recording medium. The second color ink head includes a plurality of nozzles through which first ink of a second color is ejected towards the recording medium to form ink dots of the first ink of the second color on the recording medium. The second ink ink head includes a plurality of nozzles through which second ink is ejected towards the recording medium to print ink dots of the second ink on the recording medium. The controller includes a first generator, a second generator, a first printing controller, and a second printing controller. The first generator generates, upon receipt of data on the ink dots of the first ink of the first color, a plurality of first dot groups, including a first underlying layer dot group and a first image dot group, of the ink dots of the first ink of the first color. The first generator generates the plurality of first dot groups such that the plurality of first dot groups include all of the ink dots of the first ink of the first color. The second generator generates, upon receipt of data on the ink dots of the first ink of the second color, a plurality of second dot groups, including a second underlying layer dot group and a second image dot group, of the ink dots of the first ink of the second color. The second generator generates the plurality of second dot groups such that the plurality of second dot groups include all of the ink dots of the first ink of the second color. The first printing controller prints a first printing layer, on the recording medium, of at least the ink dots of the first underlying layer dot group, the ink dots of the second underlying layer dot group and the ink dots of the second ink. The second printing controller prints a second printing layer, above or below the first printing layer, of at least the ink dots of the first image dot group and the ink dots of the second image dot group.

A printing method according to a preferred embodiment of the present invention is a printing method by which at least first ink of a first color, first ink of a second color and second ink are ejected towards a recording medium to form, on the recording medium, at least ink dots of the first ink of the first color, ink dots of the first ink of the second color and ink dots of the second ink. The printing method includes a first generation step, a second generation step, a first printing step, and a second printing step. In the first generation step, upon receipt of data on the ink dots of the first ink of the first color, a plurality of first dot groups, including a first underlying layer dot group and a first image dot group, are generated of the ink dots of the first ink of the first color. In this step, the plurality of first dot groups are generated so as to include all of the ink dots of the first ink of the first color. In the second generation step, upon receipt of data on the ink dots of the first ink of the second color, a plurality of second dot groups, including a second underlying layer dot group and a second image dot group, are generated of the ink dots of the first ink of the second color. In this step, the plurality of second dot groups are generated so as to include all of the ink dots of the first ink of the second color. In the first printing step, a first printing layer is printed, on the recording medium, of at least the ink dots of the first underlying layer dot group, the ink dots of the second underlying layer dot group and the ink dots of the second ink. In the second printing step, a second printing layer is printed, above or below the first printing layer, of at least the ink dots of the first image dot group and the ink dots of the second image dot group.

With the above-described inkjet printer, the second ink and a portion of the first ink (underlying layer dot group) are printed concurrently to provide the "first printing layer". Above or below the "first printing layer", another portion of the first ink (image dot group) is printed to provide the "second printing layer". The first ink is printed to provide the upper layer and the lower layer in an overlapping manner as described above. Therefore, the color developing property of the first ink is inhibited or prevented from being decreased, and an image appearing to be deeper and more massive is provided than by overlapping printing performed by the conventional printer. In addition, with the inkjet printer and the printing method described above, the underlying layer dot group and the image dot group are generated independently for each color of the first ink. Therefore, the image quality is adjustable based on each color of the first ink, and a desired color balance is able to be obtained even by the overlapping printing.

With the inkjet printer and the printing method described above, it is sufficient that the underlying layer dot group and the image dot group are generated independently for each of at least two colors of the first ink. For example, the underlying layer dot group and the image dot group may be generated independently for each of seven colors of process color ink as in a general printer. The sum of the underlying layer dot group and the image dot group does not need to be 100% of the ink dots, and may exceed 100%.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 7 shows an example of a matrix, usable in preferred embodiment 2 of the present invention, based on which an underlying layer printing ratio may be determined.

DETAILED DESCRIPTION OF THE PREFERRED EMBODIMENTS

Figure 1:
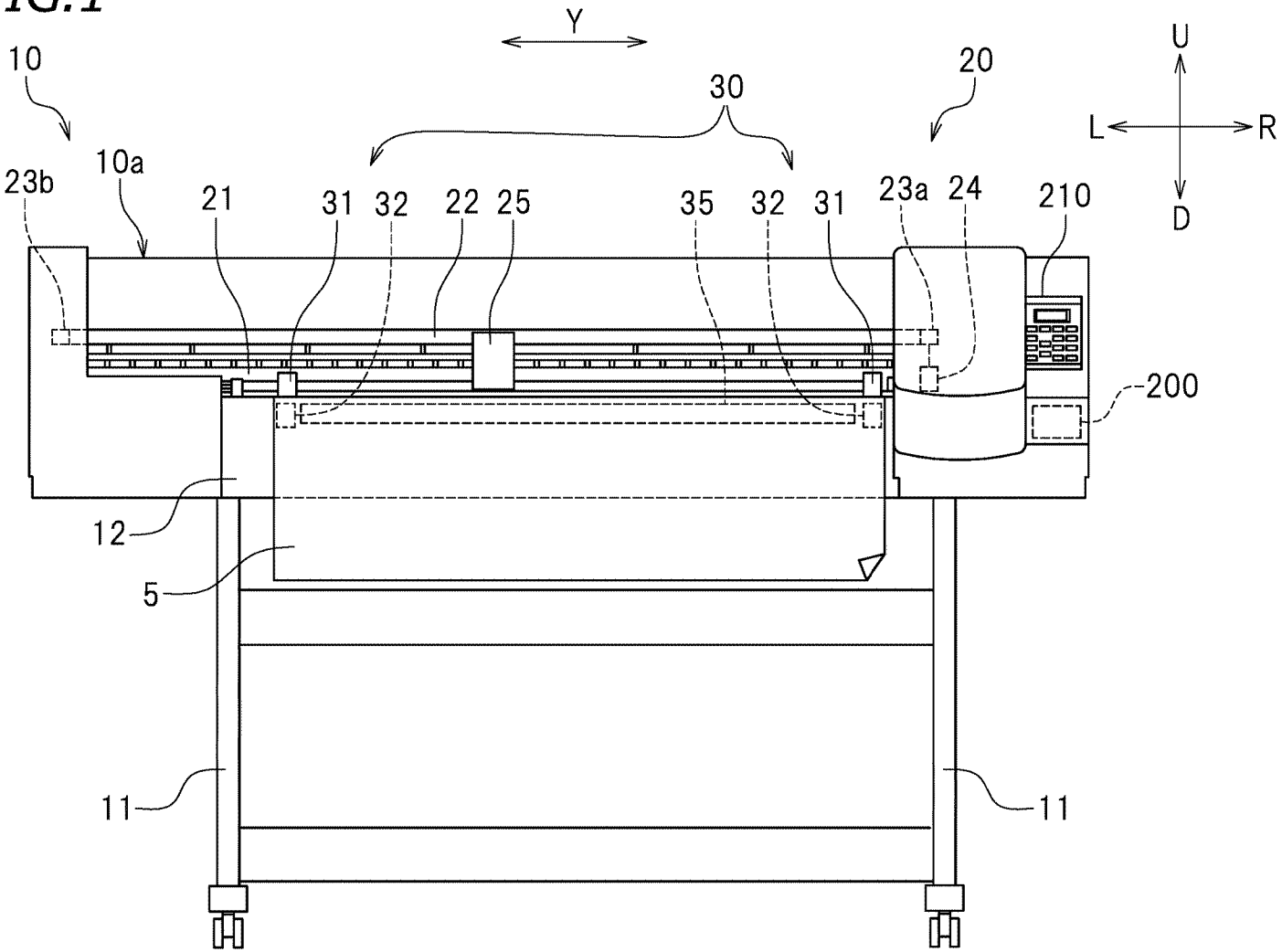
FIG. 1 is a front view of an inkjet printer according to preferred embodiment 1 of the present invention.

Hereinafter, preferred embodiments of inkjet printers according to the present invention will be described with reference to the drawings. The preferred embodiments described below are not intended to specifically limit the present invention. Components and portions that have the same functions will be denoted by the same reference signs, and overlapping descriptions will be omitted or simplified. In the following description, a direction from an inkjet printer towards a user facing a front surface of the inkjet printer is referred to as "forward", and a direction distanced from the user is referred to as "rearward". In the drawings, letter Y refers to a scanning direction, and letter X refers to a feeding direction perpendicular or substantially perpendicular to the scanning direction. In the drawings, letters F, Rr, L, R, U and D respectively refer to "front", "rear", "left", "right", and "down". These directions are also based on the user facing the front surface of the inkjet printer. It should be noted that these directions are provided merely for the sake of convenience, and do not limit the manner of installation of the inkjet printer in any way. The expression that one component is "above" (or "below") another component may refer to a state in which the one component is above (or below) the another component while being in direct contact with the another component, as well as a state in which the one component is above (or below) the another component with another component provided between the one component and the another component.

Preferred Embodiment 1

FIG. 1 is a front view of a large-scale inkjet printer (hereinafter, referred to a "printer") 10 in preferred embodiment 1. The printer 10 sequentially moves a roll of recording medium 5 forward (towards a downstream side X2 in the feeding direction X; see FIG. 2), while ejecting ink from ink heads 40 through 110 (see FIG. 2) mounted on a carriage 25 moving in the scanning direction Y, to print an image on the recording medium 5.

The recording medium 5 is a target on which an image is to be printed. There is no specific limitation on the type of the recording medium 5. The recording medium 5 may be, for example, paper, such as plain paper, printing paper for an inkjet printer, or other suitable paper. The recording medium 5 may be a transparent sheet made of a resin, glass or other suitable material. The recording medium 5 may be a sheet made of a metal material, rubber or other suitable material. In the present preferred embodiment, the recording medium 5 is preferably a transparent sheet, for example.

As shown in FIG. 1, the printer 10 includes a printer main body 10*a* and legs 11 supporting the printer main body 10*a*. The printer main body 10*a* extends in the scanning direction Y. The printer main body 10*a* includes a guide rail 21 and the carriage 25 engaged with the guide rail 21. The guide rail 21 extends in the scanning direction Y. The guide rail 21 guides the carriage 25 such that the carriage 25 moves in the scanning direction Y. An endless belt 22 is secured to the carriage 25. The belt 22 is wrapped around, and extends between, a pulley 23*a* provided at a right end of the guide rail 21 and a pulley 23*b* provided at a left end of the guide rail 21. A carriage motor 24 is attached to the right pulley 23*a*. The carriage motor 24 is electrically connected with a controller 200. The carriage motor 24 is controlled by the controller 200. When the carriage motor 24 is driven, the pulley 23*a* is rotated to run the belt 22. As a result, the carriage 25 moves in the scanning direction Y along the guide rail 21. Along with the movement of the carriage 25 in the scanning direction Y, the ink heads 40 through 110 also move in the scanning direction Y. In the present preferred embodiment, the belt 22, the pulley 23*a*, the pulley 23*b*, and the carriage motor 24 are included in an example of carriage moving mechanism 20 moving the carriage 25 and the ink heads 40 through 110, mounted on the carriage 25, in the scanning direction Y.

A platen 12 is located below the carriage 25. The platen 12 extends in the scanning direction Y. The recording medium 5 is placed on the platen 12. Pinch rollers 31 pressing the recording medium 5 from above are provided above the platen 12. The pinch rollers 31 are located to the rear of the carriage 25. The platen is provided with grit rollers 32. The grit rollers 32 are located below the pinch rollers 31. The grit rollers 32 are located at a position facing the pinch rollers 31. The grit rollers 32 are coupled with a feed motor 33 (see FIG. 3). The grit rollers 32 are rotatable upon receipt of a driving force of the feed motor 33. The feed motor 33 is electrically connected with the controller 200. The feed motor 33 is controlled by the controller 200. When the grit rollers 32 are rotated in the state in which the recording medium 5 is held between the pinch rollers 31 and the grit rollers 32, the recording medium 5 is fed in the feeding direction X. In the present preferred embodiment, the pinch rollers 31, the grit rollers 32, and the feed motor 33 are included in an example of a feeding mechanism 30 moving the recording medium 5 in the feeding direction X. The feeding mechanism 30 and the carriage moving mechanism 20 are included in a moving mechanism moving the recording medium 5 and the carriage 25 with respect to each other.

Figure 2:
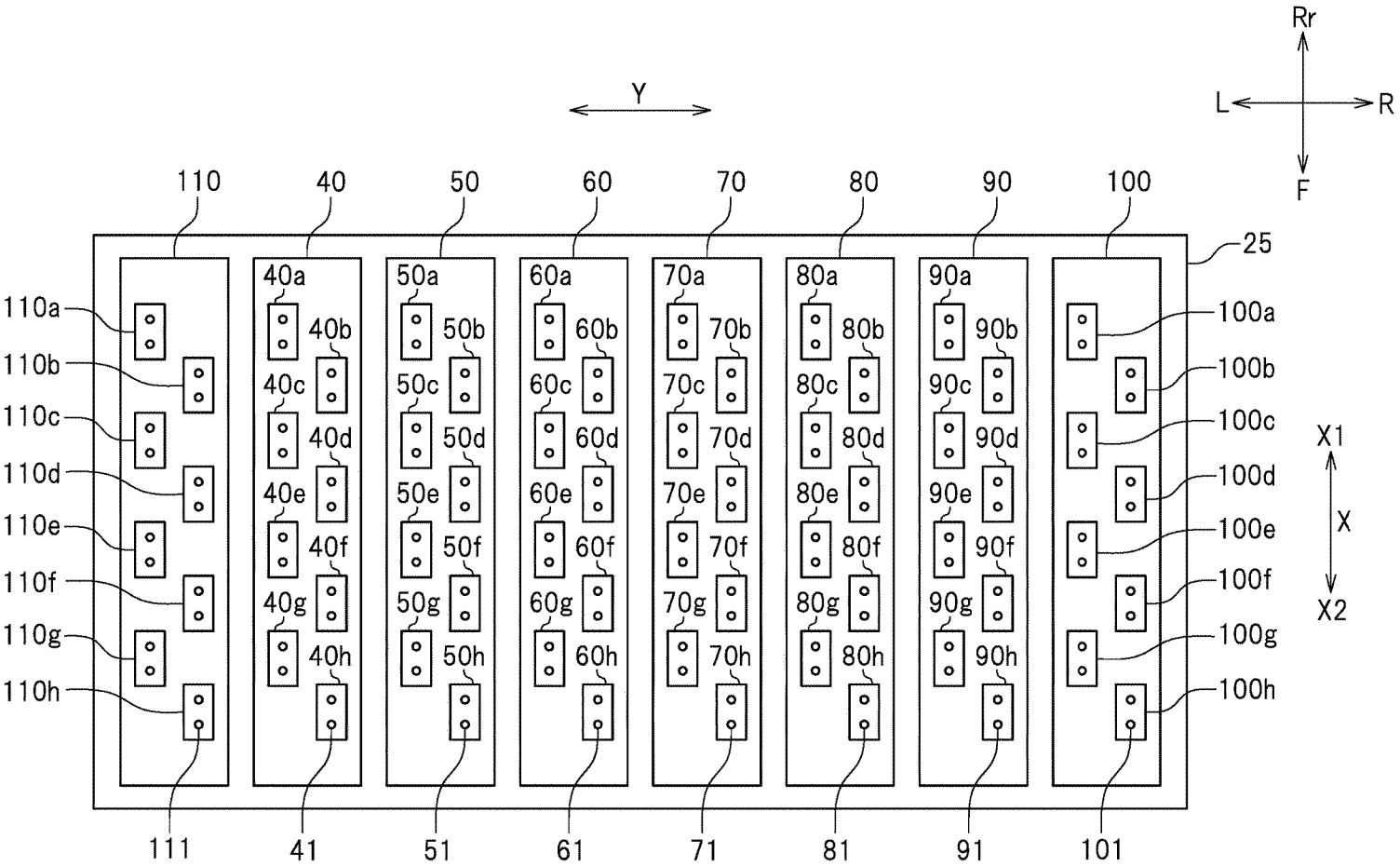
FIG. 2 is a schematic view showing a structure of a bottom surface of a carriage.

FIG. 2 is a schematic view showing a structure of a surface of the carriage 25 that faces the recording medium 5 (in the present preferred embodiment, a bottom surface of the carriage 25). As shown in FIG. 2, the carriage 25 holds, at the bottom surface, the ink heads 40 through 110, more specifically, a first process color ink head 40, a second process color ink head 50, a third process color ink head 60, a fourth process color ink head 70, a fifth process color ink head 80, a sixth process color ink head 90, a seventh process color ink head 100, and a special color ink head 110. As shown in FIG. 2, the first process color ink head 40 through the seventh process color ink head 100 and the special color ink head 110 are located side by side in the scanning direction Y on the carriage 25. Herein, the "first process color ink head" refers to the ink head for the first process color, and this is also applicable to the other ink heads.

In the present preferred embodiment, the special color ink head 110 ejects special color ink that changes the color tone or the design of a color image. The special color ink is an example of "second ink". In this example, the special color ink head 110 ejects white ink. The color tone of the special color ink is not limited to white. The "special color ink" preferably includes ink other than the process color ink, such as C ink, M ink, Y ink, K ink or other suitable color ink, for example, metallic ink, such as silver ink, gold ink or other suitable metallic ink, and transparent ink, for example. In the present preferred embodiment, one special color ink head is preferably provided. The number of the special color ink head(s) is not limited to one. For example, two or more special color ink heads may be provided. There is no limitation on the color tone of the special color ink. The special color ink head 110 may eject, for example, metallic ink, such as silver ink, gold ink or other suitable metallic ink, or transparent ink.

As shown in FIG. 2, the special color ink head 110 includes eight sub ink heads 110*a* through 110*h*. The eight sub ink heads 110*a* through 110*h* each include a plurality of nozzles 111, through which the ink is ejected. The plurality of nozzles 111 are arrayed in one line in the feeding direction X in each sub ink head. The sub ink heads 110*a* through 110*h* preferably include the same number of nozzles 11 with each other. The positional arrangement of the nozzles 111 in each sub ink head is not limited to the above-described positional arrangement. The sub ink heads 110*a* through 110*h* do not need to include the same number of nozzles 111 with each other. In FIG. 2, the sub ink heads 110*a* through 110*h* are each shown as including two nozzles 111. In actuality, the sub ink heads 110*a* through 110*h* each preferably include a larger number of (e.g., 40) nozzles 111. There is no limitation on the number of the nozzles 111 included in the sub ink heads 110*a* through 110*h*.

In the special color ink head 110, the eight sub ink heads 110*a* through 110*h* are located in a staggered arrangement. More specifically, the eight sub ink heads 110*a* through 110*h* are arrayed in this order from an upstream side X1 in the feeding direction X toward the downstream side X2 while being disposed in two lines, namely, a left line and a right line. Among the eight sub ink heads 110*a* through 110*h*, the sub ink heads 110*a*, 110*c*, 110*e* and 110*g* are arrayed in one line in the feeding direction X. To the right of the sub ink heads 110*a*, 110*c*, 110*e* and 110*g*, the sub ink heads 110*b*, 110*d*, 110*f* and 110*h* are arrayed in one line in the feeding direction X. The sub ink heads 110*a* through 110*h* are located alternately in the left line and the right line. The sub ink heads 110*a* through 110*h* are located intermittently as described above, but are continuous in the feeding direction X if the left line and the right line are considered as being combined together. In an actual ink head, the sub ink heads may be located while overlapping each other partially in the feeding direction X such that the nozzles 111 are located continuously in the feeding direction X.

The first process color ink head 40 through the seventh first process color ink head 100 each eject process color ink usable to produce a color image. The process color ink is an example of "first ink". In the present preferred embodiment, the first process color ink head 40 ejects cyan ink. The second process color ink head 50 ejects magenta ink. The third process color ink head 60 ejects yellow ink. The fourth process color ink head 70 ejects black ink. The fifth process color ink head 80 ejects gray ink. The sixth process color ink head 90 ejects light cyan ink. The seventh process color ink head 100 ejects light magenta ink. The number of the process color ink heads is not limited to seven. There is no limitation on the color tone of the process color ink.

As shown in FIG. 2, the first process color ink head 40 includes eight sub ink heads 40*a* through 40*h*. The eight sub ink heads 40*a* through 40*h* each include a plurality of nozzles 41, through which the ink is ejected. The plurality of nozzles 41 are arrayed in one line in the feeding direction X in each sub ink head. The nozzles 41 in the first process color ink head 40 are arrayed at positions that are matched, in the feeding direction X, to the positions of the nozzles 111 in the special color ink head 110. The number of the nozzles 41 included in each of the sub ink heads 40*a* through 40*h* of the first process color ink head 40 is preferably equal to the number of the nozzles 111 included in each of the sub ink heads 110*a* through 110*h* of the special color ink head 110. The positional arrangement of the nozzles 41 in each sub ink head of the first process color ink head 40 is not limited to the above-described positional arrangement. The sub ink heads 40*a* through 40*h* do not need to include the same number of nozzles 41 with each other.

In the first process color ink head 40, the sub ink heads 40*a* through 40*h* are arrayed in the same or substantially the same manner as in the special color ink head 110. Namely, the eight sub ink heads 40*a* through 40*h* are arrayed in this order from the upstream side X1 toward the downstream side X2 in the feeding direction X while being disposed in two lines, namely, a left line and a right line. More specifically, the sub ink heads 40*a*, 40*c*, 40*e* and 40*g* are arrayed in the left line, and the sub ink heads 40*b*, 40*d*, 40*f* and 40*h* are arrayed in the right line. In the first process color ink head 40, the sub ink heads 40*a* through 40*h* are located continuously in the feeding direction X if the left line and the right line are considered as being combined together.

The second process color ink head 50 through the seventh process color ink head 100 preferably have the same or substantially the same structure as that of the first process color ink head 40. Specifically, the second process color ink head 50 includes eight sub ink heads 50*a* through 50*h* arrayed in a staggered arrangement. The sub ink heads 50*a* through 50*h* each include nozzles 51 arrayed in the feeding direction X. The third process color ink head 60 includes eight sub ink heads 60*a* through 60*h* arrayed in a staggered arrangement. The sub ink heads 60*a* through 60*h* each include nozzles 61 arrayed in the feeding direction X. The fourth process color ink head 70 includes eight sub ink heads 70*a* through 70*h* arrayed in a staggered arrangement. The sub ink heads 70*a* through 70*h* each include nozzles 71 arrayed in the feeding direction X. The fifth process color ink head 80 includes eight sub ink heads 80*a* through 80*h* arrayed in a staggered arrangement. The sub ink heads 80*a* through 80*h* each include nozzles 81 arrayed in the feeding direction X. The sixth process color ink head 90 includes eight sub ink heads 90*a* through 90*h* arrayed in a staggered arrangement. The sub ink heads 90*a* through 90*h* each include nozzles 91 arrayed in the feeding direction X. The seventh process color ink head 100 includes eight sub ink heads 100*a* through 100*h* arrayed in a staggered arrangement. The sub ink heads 100*a* through 100*h* each include nozzles 101 arrayed in the feeding direction X. The nozzles in the first process color ink head 40 through the seventh process color ink head 100 and the special color ink head 110 are located at matching positions with each other in the feeding direction X. The first process color ink head 40 through the seventh process color ink head 100 and the special color ink head 110 include the same number of nozzles.

The first process color ink head 40 through the seventh process color ink head 100 and the special color ink head 110 each include actuators provided therein. More specifically, the first process color ink head 40 includes first process color actuators (see FIG. 3) provided therein. The second process color ink head 50 includes second process color actuators 53 (see FIG. 3) provided therein. The third process color ink head 60 includes third process color actuators 63 (see FIG. 3) provided therein. The fourth process color ink head 70 includes fourth process color actuators 73 (see FIG. 3) provided therein. The fifth process color ink head 80 includes fifth process color actuators 83 (see FIG. 3) provided therein. The sixth process color ink head 90 includes sixth process color actuators 93 (see FIG. 3) provided therein. The seventh process color ink head 100 includes seventh process color actuators 103 (see FIG. 3) provided therein. The special color ink head 110 includes special color actuators 113 (see FIG. 3) provided therein. In the present preferred embodiment, the actuators provided in the ink heads are all preferably of the same type. Thus, the first process color actuators 43 provided in the first process color ink head 40 will be described. In the present preferred embodiment, the first process color actuators 43 each include a pressure chamber 43*a* and a piezoelectric element 43*b* (see FIG. 10A and FIG. 10B). The ink is stored in the pressure chamber 43*a*, and one nozzle 41 is provided at a bottom surface of the pressure chamber 43*a*. The piezoelectric element 43*b* is provided in contact with the pressure chamber 43*a*, and is displaced to contract the pressure chamber 43*a* when being driven. The first process color actuators 43 are electrically connected with the controller 200 (see FIG. 1), and are controlled by the controller 200. The first process color actuators 43 are driven, and as a result, the ink (in the present preferred embodiment, the cyan ink) is ejected towards the recording medium 5 from the nozzles 41 of the first process color ink head 40. The second process color ink head 50 through the seventh process color ink head 100 and the special color ink head 110 are operated in the same or substantially the same manner. Herein, the "first process color actuator" refers to the "actuator for the first process color", and this is also applicable to the other actuators.

The first process color ink head 40 through the seventh process color ink head 100 and the special color ink head 110 are each in communication with an ink cartridge (not shown) via an ink supply path (not shown). The ink cartridge is preferably detachably located at, for example, a right end of the printer main body 10*a*. There is no limitation on the material of the ink, and any of various materials conventionally used as an ink material for an inkjet printer may be used. The ink may preferably be, for example, solvent-based pigment ink or aqueous pigment ink. Alternatively, the ink may be aqueous dye ink, ultraviolet-curable pigment ink cured upon receipt of ultraviolet rays, or other suitable inks.

As shown in FIG. 1, the printer 10 includes a heater 35. The heater 35 is provided below the platen 12. The heater 35 is located to the front of the grit rollers 32. The heater 35 heats the platen 12. The platen 12 is heated, so that the recording medium 5 placed on the platen 12 and the ink that has landed on the recording medium 5 are heated. Thus, the drying of the ink is promoted. The heater 35 is electrically connected with the controller 200. The temperature to which the heater 35 is heated is controlled by the controller 200.

Figure 3:
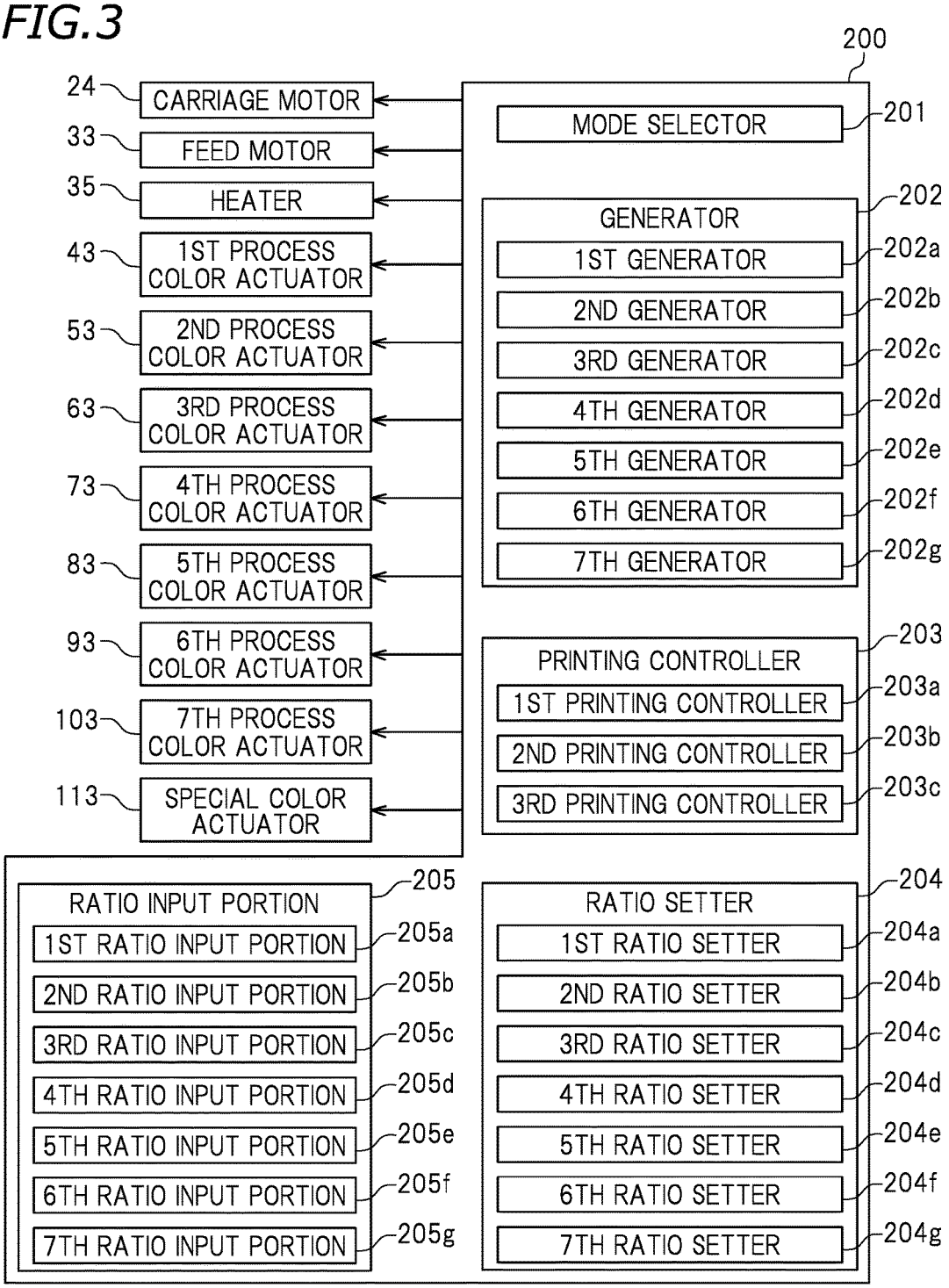
FIG. 3 is a block diagram of the printer.

As shown in FIG. 1, an operation panel 210 is provided at the right end of the printer main body 10*a*. The operation panel 210 includes a display that displays a state of the printer 10, input keys operable by the user, and other controls. The controller 200 controlling various operations of the printer 10 is accommodated in the operation panel 210. FIG. 3 is a block diagram of the printer 10 in the present preferred embodiment. As shown in FIG. 3, the controller 200 is communicably connected with, and is configured and/or programmed to control the feed motor 33, the carriage motor 24, the heater 35, and the actuators 43 through 113 provided in the ink heads. The controller 200 is configured and/or programmed to include a mode selector 201, a generator 202, a printing controller 203, a ratio setter 204, and a ratio input portion 205. The generator 202 includes a first generator 202*a* through a seventh generator 202*g*. The printing controller 203 includes a first printing controller 203*a* through a third printing controller 203*c*. The ratio setter 204 includes a first ratio setter 204*a* through a seventh ratio setter 204*g*. The ratio input portion 205 includes a first ratio input portion 205*a* through a seventh ratio input portion 205*g*.

There is no specific limitation on the structure of the controller 200. The controller 200 is preferably, for example, a microcomputer. There is no specific limitation on the hardware structure of the microcomputer. The microcomputer preferably includes, for example, an interface (I/F) receiving printing data or other data from an external device, such as a host computer or other suitable device, a central processing unit (CPU) executing a command of a control program, a ROM (read only memory) including, stored thereon, the program executable by the CPU, a RAM (random access memory) usable as a working area in which the program is developed, and a storage, such as a memory or other suitable storage that stores the above-described program and various types of data. The controller 200 does not need to be provided inside the printer main body 10*a*. The controller 200 may be, for example, a computer that is located outside the printer main body 10*a* and is communicably connected with the printer main body 10*a* in a wired or wireless manner.

The mode selector 201 is usable to select a printing mode. In the present preferred embodiment, the printing mode is classified into "normal printing" and "overlapping printing". The "overlapping printing" is classified into "first overlapping printing" and "second overlapping printing". According to the "first overlapping printing", an underlying color layer is provided as a lower layer of the special color ink and a portion of the process color ink, and then an image layer is provided as an upper layer of a portion of the process color ink. According to the "second overlapping printing", an image layer is provided as a lower layer of a portion of the process color ink, and then an underlying color layer is provided as an upper layer of the special color ink and a portion of the process color ink. The "first overlapping printing" and the "second overlapping printing" will be described in detail below. When the "first overlapping printing" mode is selected, the mode selector 201 instructs the first printing controller 203*a* and the second printing controller 203*b* to perform the "first overlapping printing". When the "second overlapping printing" mode is selected, the mode selector 201 instructs the first printing controller 203*a* and the second printing controller 203*b* to perform the "second overlapping printing". When the "normal printing" mode is selected, the mode selector 201 instructs the third printing controller 203*c* to perform the "normal printing". The printing mode may be incorporated in advance into the printing data and automatically selected. Alternatively, the printing mode may be selected appropriately by an operator.

Upon receipt of data on ink dots of the various colors of process color ink, the generator 202 generates a plurality of "underlying layer dot groups" and a plurality of "image dot groups" of the ink dots of the process color ink. The generator 202 is divided into portions respectively corresponding to the process color ink heads. The first generator 202*a* generates a "first underlying layer dot group" and a "first image dot group" of the ink dots of the process color ink ejected from the first process color ink head 40 (in the present preferred embodiment, the cyan ink). The second generator 202*b* generates a "second underlying layer dot group" and a "second image dot group" of the ink dots of the process color ink ejected from the second process color ink head 50 (in the present preferred embodiment, the magenta ink). The third generator 202*c* generates a "third underlying layer dot group" and a "third image dot group" of the ink dots of the process color ink ejected from the third process color ink head 60 (in the present preferred embodiment, the yellow ink). The fourth generator 202*d* generates a "fourth underlying layer dot group" and a "fourth image dot group" of the ink dots of the process color ink ejected from the fourth process color ink head 70 (in the present preferred embodiment, the black ink). The fifth generator 202*e* generates a "fifth underlying layer dot group" and a "fifth image dot group" of the ink dots of the process color ink ejected from the fifth process color ink head 80 (in the present preferred embodiment, the gray ink). The sixth generator 202*f* generates a "sixth underlying layer dot group" and a "sixth image dot group" of the ink dots of the process color ink ejected from the sixth process color ink head 90 (in the present preferred embodiment, the light cyan ink). The seventh generator 202*g* generates a "seventh underlying layer dot group" and a "seventh image dot group" of the ink dots of the process color ink ejected from the seventh process color ink head 100 (in the present preferred embodiment, the light magenta ink). The "first underlying layer dot group" and the "first image dot group" both include a portion of, or the entirety of, the ink dots of the cyan ink. The "first underlying layer dot group" and the "first image dot group" are generated to match the entirety of the ink dots of the cyan ink when being combined together. Namely, where the entirety of the ink dots of the cyan ink is 100%, the sum of the "first underlying layer dot group" and the "first image dot group" is 100%. This is applicable to the other underlying layer dot groups and the other image dot groups. The "first through seventh underlying layer dot groups" and the "first through seventh image dot groups" will be described in detail below. A method for generating the "first through seventh underlying layer dot groups" and the "first through seventh image dot groups" will be described in detail below. Herein, the "first underlying layer dot group" refers to the first dot group for the underlying layer", and this is also applicable to the other dot groups.

The printing controller 203 controls the printing operation. The printing controller 203 is connected with the carriage motor 24, the feed motor 33, and the actuators 43 through 113 respectively provided in the ink heads 40 through 110. The printing controller 203 controls these components to perform printing. The printing controller 203 controls the temperature of the heater 35 to promote the drying of the ink after the ejection.

In the printing controller 203, the first printing controller 203*a* controls a concurrent printing operation of a work of printing with the special color ink and a work of providing the "underlying layer dot group" with each color of process color ink. Hereinafter, a printing layer provided by the above-described concurrent printing operation may be referred to as a "first printing layer". The "first printing layer" is an underlying color layer including a portion of an image including the process color ink mixed therein. The first printing controller 203*a* is connected with the carriage motor 24, the feed motor 33, and the actuators 43 through 113 respectively provided in the ink heads 40 through 110. The first printing controller 203*a* controls these components to perform the concurrent printing operation of printing the special color ink and the "underlying layer dot groups". The first printing controller 203*a* controls the carriage motor 24, the feed motor 33, and the actuators 43 through 113 in a different manner in accordance with which of the "first overlapping printing" and the "second overlapping printing" is selected by the mode selector 201. More specifically, when the "first overlapping printing" is selected by the mode selector 201, the first printing controller 203*a* controls the components such that the "first printing layer" is provided as the lower layer. In contrast, when the "second overlapping printing" is selected by the mode selector 201, the first printing controller 203*a* controls the components such that the "first printing layer" is provided as the upper layer. The details of the control will be described below.

In the printing controller 203, the second printing controller 203*b* controls a printing work of providing the "image dot group" with each color of process color ink. Hereinafter, a printing layer provided by such printing may be referred to as a "second printing layer". The "second printing layer" is an image layer. The "second printing layer" is provided above or below the "first printing layer". When the "first overlapping printing" is selected by the mode selector 201, the "second printing layer" is provided above the "first printing layer". In contrast, when the "second overlapping printing" is selected by the mode selector 201, the "second printing layer" is provided below the "first printing layer". The second printing controller 203*b* is connected with the carriage motor 24, the feed motor 33, and the actuators 43 through 113 respectively provided in the ink heads 40 through 110. The second printing controller 203*b* controls these components to form the "second printing layer". The details of the control will be described below.

When the "normal printing" is selected by the mode selector 201, the third printing controller 203*c* controls the carriage motor 24, the feed motor 33, and the actuators 43 through 103 respectively provided in the process color ink heads 40 through 100 to perform the "normal printing" on the recording medium 5. A process of the "normal printing" will be described below.

The ratio setter 204 sets the ratio of the "underlying layer dot group" and the ratio of the "image dot group" with respect to the entirety of the ink dots of each color of process color ink. The process of generating each of the "underlying layer dot groups" and each of the "image dot groups" based on the ratios set by the ratio setter 204 may preferably be performed automatically based on preset generation conditions. Alternatively, the work may be performed in accordance with the generation conditions input by the operator. In the printer 10 in the present preferred embodiment, the process of generating each of the "underlying layer dot groups" and each of the "image dot groups" is preferably performed in accordance with the generation conditions input by the operator. The ratio setter 204 issues, to the generator 202, an instruction on the ratios of the "underlying layer dot group" and the "image dot group" with respect to the entirety of the ink dots of each color of process color ink, as generation conditions under which the "underlying layer dot group" and the "image dot group" are to be generated of the ink dots of each color of process color ink. The instruction is provided independently for each color of process color ink. The ratio setter 204 includes the first ratio setter 204*a* through the seventh ratio setter 204*g*. The first ratio setter 204*a* sets the ratios of the "first underlying layer dot group" and the "first image dot group" with respect to the entirety of the ink dots of the cyan ink ejected from the first process color ink head 40. The second ratio setter 204*b* sets the ratios of the "second underlying layer dot group" and the "second image dot group" with respect to the entirety of the ink dots of the magenta ink ejected from the second process color ink head 50. The third ratio setter 204*c* sets the ratios of the "third underlying layer dot group" and the "third image dot group" with respect to the entirety of the ink dots of the yellow ink ejected from the third process color ink head 60. The fourth ratio setter 204*d* sets the ratios of the "fourth underlying layer dot group" and the "fourth image dot group" with respect to the entirety of the ink dots of the black ink ejected from the fourth process color ink head 70. The fifth ratio setter 204*e* sets the ratios of the "fifth underlying layer dot group" and the "fifth image dot group" with respect to the entirety of the ink dots of the gray ink ejected from the fifth process color ink head 80. The sixth ratio setter 204*f* sets the ratios of the "sixth underlying layer dot group" and the "sixth image dot group" with respect to the entirety of the ink dots of the light cyan ink ejected from the sixth process color ink head 90. The seventh ratio setter 204*g* sets the ratios of the "seventh underlying layer dot group" and the "seventh image dot group" with respect to the entirety of the ink dots of the light magenta ink ejected from the seventh process color ink head 100. The ratio setter 204 will be described in detail below.

The ratio input portion 205 is used to input the ratios of the "underlying layer dot group" and the "image dot group" with respect to the entirety of the ink dots of each color of process color ink. The ratio input portion 205 includes interfaces to which the ratios may be input. The ratios may be input independently for each color of process color ink. The ratio input portion 205 includes the first ratio input portion 205*a* through the seventh ratio input portion 205*g*. The first ratio setter 204*a* sets the ratios of the "first underlying layer dot group" and the "first image dot group" with respect to the entirety of the ink dots of the cyan ink to the ratios input to the first ratio input portion 205*a*. Similarly, the second ratio setter 204*b* sets the ratios of the "second underlying layer dot group" and the "second image dot group" with respect to the entirety of the ink dots of the magenta ink to the ratios input to the second ratio input portion 205*b*. The third ratio setter 204*c* sets the ratios of the "third underlying layer dot group" and the "third image dot group" with respect to the entirety of the ink dots of the yellow ink to the ratios input to the third ratio input portion 205*c*. The fourth ratio setter 204*d* sets the ratios of the "fourth underlying layer dot group" and the "fourth image dot group" with respect to the entirety of the ink dots of the black ink to the ratios input to the fourth ratio input portion 205*d*. The fifth ratio setter 204*e* sets the ratios of the "fifth underlying layer dot group" and the "fifth image dot group" with respect to the entirety of the ink dots of the gray ink to the ratios input to the fifth ratio input portion 205*d*. The sixth ratio setter 204*f* sets the ratios of the "sixth underlying layer dot group" and the "sixth image dot group" with respect to the entirety of the ink dots of the light cyan ink to the ratios input to the sixth ratio input portion 205*f*. The seventh ratio setter 204*g* sets the ratios of the "seventh underlying layer dot group" and the "seventh image dot group" with respect to the entirety of the ink dots of the light magenta ink to the ratios input to the seventh ratio input portion 205*g*.

According to the "normal printing", one layer is printed on the recording medium 5. For the "normal printing", only the process color ink is used. In the "normal printing", the entirety of the ink dots of each color of process color ink is printed. The "normal printing" is performed as follows. The third printing controller 203*c* drives the carriage motor 24 to move the carriage 25 in the scanning direction Y. The third printing controller 203*c* drives the process color actuators 43 through 103 to cause the process color ink heads 40 through 100 to eject the ink, so that the process color ink lands on a printing surface of the recording medium 5. In addition, the third printing controller 203*c* controls the feed motor 33 such that the recording medium 5 is sequentially fed forward (F) (toward the downstream side X2 in the feeding direction X). The ink on the recording medium 5 fed by the feed motor 33 is sequentially heated by the heater 35 and thus is dried. The third printing controller 203*c*, for example, moves the carriage 25 in the scanning direction Y once or a plurality of times by the time when the recording medium 5 is fed forward (F) once.

In the overlapping printing modes including the "first overlapping printing" mode and the "second overlapping printing" mode, an underlying color layer and an image layer are provided in an overlapping manner on the recording medium 5. In the case in which the recording medium 5 is not white as in the present preferred embodiment (in the present preferred embodiment, the recording medium 5 is transparent), such overlapping printing is often performed on a recording medium. Often, the process color ink ejected directly onto a recording medium that is not white does not develop the real color thereof. Therefore, first, a white ink layer is printed on the recording medium, and then, an image is printed on the white ink layer. In this manner, a color close to the real color of the ink is printed even on a recording medium that is not white. The overlapping printing is also performed in a case other than the above-described case. For example, a special color ink layer of transparent ink, metallic ink or other suitable ink may be provided above or below the image, so that a specific visual effect is provided. In the case in which the recording medium 5 is a transparent sheet as in the present preferred embodiment, the overlapping printing is performed primarily to provide the image with an underlying color (in the present preferred embodiment, white). To provide a printed item, a printing surface of which is to be viewed, the special color ink layer is provided below the image. For providing a printed item, a surface opposite to the printing surface of which is to be viewed, the special color ink layer is provided above the image.

For the overlapping printing, there are requirements for a higher image quality. In the field of, for example, outdoor advertisements, there is a need for an image giving a strong impression of having depth or massiveness in order to attract more attention. However, often, the conventional printing method does not sufficiently fulfill such a need. A reason for this is that the image layer is thin and, thus, the influence of special color ink defining the underlying color layer is not completely eliminated. More specifically, one reason is that the maximum amount of the process color ink that is able to be printed to define the image layer is decreased because there is a limit on the amount of ink that is able to be accepted by the recording medium. Another reason is that the color developing property of the process color ink is decreased by the process color ink being printed on the underlying color layer. For example, in the case in which the special color ink is white ink as in the present preferred embodiment, the image appears whitish and, thus, lacks depth or massiveness. In the case in which the printing is performed in an overlapping manner, the degree of influence of the special color ink varies in accordance with the color of the process color ink. As a result, an image having a different color balance from that of the original image may be provided.

In order to deal with such a situation, the controller 200 in the present preferred embodiment includes the generator 202, the first printing controller 203*a*, and the second printing controller 203*b*, so that a portion of the image is printed concurrently with the underlying color layer. This will be described more specifically below. Each of the first generator 202*a* through the seventh generator 202*g* of the generator 202, upon receipt of data on ink dots of the corresponding color of process color ink, provides the "underlying layer dot group" and the "image dot group" of the ink dots of the process color ink. The "underlying layer dot group" and the "image dot group" are provided so as to match the entirety of the ink dots of the corresponding color of process color ink when being combined together. The first printing controller 203*a* provides the "first printing layer", on the recording medium 5, of the ink dots of the special color ink and the ink dots of the "underlying ink dot groups" of the plurality of colors of process color ink. The expression that the "first printing layer" is provided "on" the recording medium 5 does not necessarily indicate that the "first printing layer" is provided in contact with the recording medium 5, and encompasses a case in which another printing layer (e.g., "second printing layer") is provided between the "first printing layer" and the recording medium 5. The second printing controller 203*b* provides the "second printing layer" of the ink dots of the "image dot groups" of the plurality of colors of process color ink, above or below the "first printing layer". In the case in which the "first printing layer" is provided as the lower layer whereas the "second printing layer" is provided as the upper layer, the "first overlapping printing" has been selected by the mode selector 201. In the case in which the "second printing layer" is provided as the lower layer whereas the "first printing layer" is provided as the upper layer, the "second overlapping printing" has been selected by the mode selector 201.

As described above, the printer 10 according to the present preferred embodiment prints the underlying color and a portion of the image concurrently as the "first printing layer". Namely, the underlying color layer is printed with a portion of the image being mixed therein. With this arrangement, the color developing property of the process color ink is inhibited or prevented from being decreased, and a color close to the real color of the process color ink is provided. Therefore, the printer 10 according to the present preferred embodiment provides an image appearing to be deeper and more massive than by overlapping printing performed by the conventional printer. In addition, the printer 10 according to the present preferred embodiment generates the "underlying layer dot group" and the "image dot group" independently for each of the plurality of colors of process color ink. Therefore, the image quality is adjustable based on each color of process color ink, and a desired color balance is obtained even by the overlapping printing.

In the case in which the recording medium is transparent, the image of the printed item provided by the printer 10 in the present preferred embodiment is visually recognizable also from the side of the underlying color layer. In the case in which the printing is performed on a transparent recording medium with the conventional overlapping printing, the level of the light blocking property of the underlying color layer is increased in order to provide a clear image. Namely, the underlying color layer is preferably thick or has a high density. However, in the state in which the level of the light blocking property of the underlying color layer is increased, the image is not visually recognizable from the side of the underlying color layer. This may cause a problem in position alignment in, for example, a bonding process in which a plurality of recording mediums need to be positionally aligned. The printer 10 according to the present preferred embodiment provides a printed item allowing the image to be visually recognizable from the side of the underlying color layer while the level of the light blocking property of the underlying color layer is maintained high.

Hereinafter, a process of generating each of the "underlying layer dot groups" and each of the "image dot groups" and a process of "overlapping printing" performed by the printer 10 according to the present preferred embodiment will be described. First, a process of generating the "underlying layer dot group" and the "image dot group" of the ink dots of each color of process color ink will be described.

Figure 4:
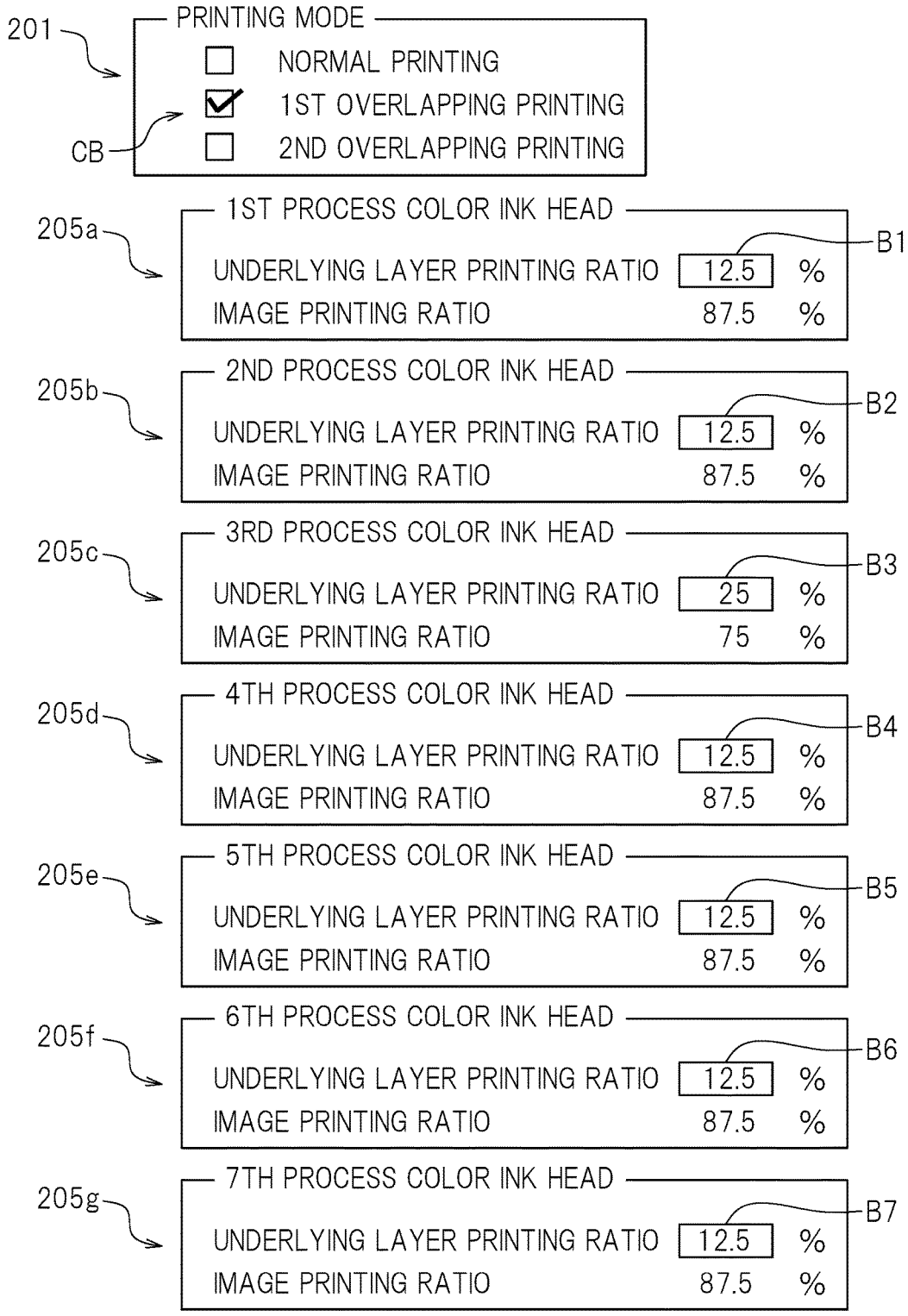
FIG. 4 shows an example of interfaces of a mode selector and a ratio input portion.

FIG. 4 shows an example of interfaces of the mode selector 201 and the ratio input portion 205. The ratio input portion 205 in the present preferred embodiment includes the interfaces to which the operator may input generation conditions for each color of process color ink under which the "underlying layer dot group" and the "image dot group" are to be generated. The interfaces of the mode selector 201 and the ratio input portion 205 are preferably displayed on, for example, a display device of a computer. As shown in the interfaces shown in FIG. 4, the ratio input portion 205 includes the first ratio input portion 205*a* through the seventh ratio input portion 205*g*. The first ratio input portion 205*a* through the seventh ratio input portion 205*g* respectively include check boxes B1 through B7, to each of which an "underlying layer printing ratio" may be input. The mode selector 201 includes check boxes CB usable to select the printing mode.

As shown in FIG. 4, the mode selector 201 allows one of the printing modes to be selected using the check box CB. Among the three printing modes of the "normal printing", the "first overlapping printing", and the "second overlapping printing", the mode selector 201 selects the printing mode, the check box CB of which has been checked. In the example shown in FIG. 4, the selected printing mode is the "first overlapping printing". Therefore, in the example shown in FIG. 4, the "first printing layer" is printed as the lower layer and the "second printing layer" is printed as the upper layer.

To each of the input boxes B1 through B7, the operator may input a numerical value as the "underlying layer printing ratio". The "underlying layer printing ratio" is a ratio of the "underlying layer dot group" with respect to the entirety of the ink dots of each color of process color ink. Namely, the "underlying layer printing ratio" is the ratio of the image to be printed concurrently with the underlying color layer. As described above, in the present preferred embodiment, the sum of the ratios of the "underlying layer dot group" and the "image dot group" of each color of process color ink is 100% with respect to the entirety of the ink dots of the process color ink. The expression that the generator 202 in the present preferred embodiment "generates" the "underlying layer dot group" and the "image dot group" of the ink dots of each color of process color ink substantially indicates that the ink dots of the process color ink is "divided". Therefore, once the underlying layer printing ratio is input to each of the interfaces shown in FIG. 4, the ratio of the "image dot group" with respect to the ink dots of the corresponding process color ink (i.e., "image printing ratio") is automatically calculated. In the example shown in FIG. 4, "12.5%", for example, is input to the input box B1 of the first ratio input portion 205*a* as the underlying layer printing ratio. Therefore, the image printing ratio is about 87.5%, for example. This indicates that about 12.5% of the cyan ink is mixed in the "first printing layer" and about 87.5% of the cyan ink is used to provide the "second printing layer", for example. In other words, about 87.5% of the ink dots of the cyan ink, which is not extracted for the "underlying layer dot group", is extracted for the "image dot group". As in the first ratio input portion 205*a*, numerical values are input to the input boxes B2 through B7 of the second ratio input portion 205*b* through the seventh ratio input portion 205*g*. In the example shown in FIG. 4, "12.5%" is input to the input box B2 as the underlying layer printing ratio. "25%" is input to the input box B3 as the underlying layer printing ratio. "12.5%" is input to the input box B4 as the underlying layer printing ratio. "12.5%" is input to the input box B5 as the underlying layer printing ratio. "12.5%" is input to the input box B6 as the underlying layer printing ratio. "12.5%" is input to the input box B7 as the underlying layer printing ratio. Namely, the underlying layer printing ratio of the yellow ink is set to about 25%, and the underlying layer printing ratio of each of the other six colors of process color ink is set to about 12.5%. In this manner, the printer 10 according to the present preferred embodiment allows the underlying layer printing ratio to be set independently for each color of process color ink. The underlying layer printing ratio may be set to 0% or 100%. In the case in which the underlying layer printing ratio is set to 0% and the image printing ratio is set to 100%, the conventional overlapping printing is performed. In the case in which the underlying layer printing ratio is set to 100% and the image printing ratio is set to 0%, all of the corresponding colors of process color ink are printed concurrently with the special color ink.

In the process of generating the "underlying layer dot group", the ink dots belonging to the "underlying layer dot group" are randomly extracted from all of the ink dots of the corresponding color of process color ink. In the case in which, for example, the underlying printing ratio is about 25%, for example, the number of ink dots corresponding to about 25% of all of the ink dots of the corresponding color of process color ink is extracted randomly. Since the number of the ink dots included in the image is very large, a situation in which the ink dots are extracted from a particular region does not occur easily. Therefore, a dot pattern similar to the pattern of the original image, except that the printing density is lower, is extracted for each color of process color ink.

As described above, the ratio input portion 205 allows the settings of the ratios of the "underlying layer dot group" and the "image dot group" with respect to the ink dots of each color of process color ink. Such settings allow the printing image quality in a finished state to be precisely adjusted.

Based on the knowledge of the inventor of preferred embodiments of the present invention, it is preferred that the "underlying layer dot group" of each color of process color ink is set to about 0.5% or higher and lower than about 50%, for example. More preferably, the ratio is about 10% to about 20%, for example.

Figure 5:
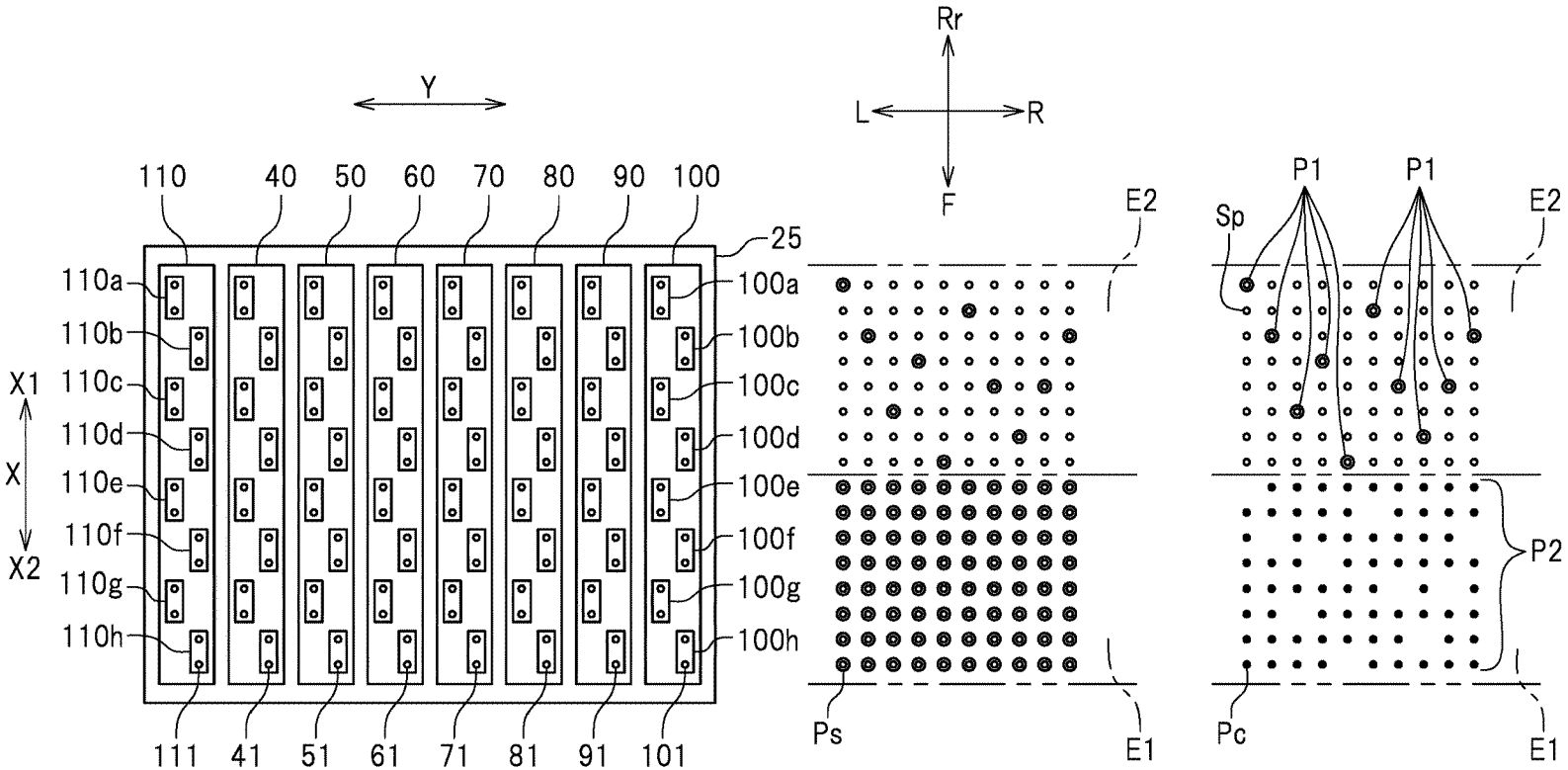
FIG. 5 is a schematic view showing positions at which ink lands in overlapping printing.
Figure 6:
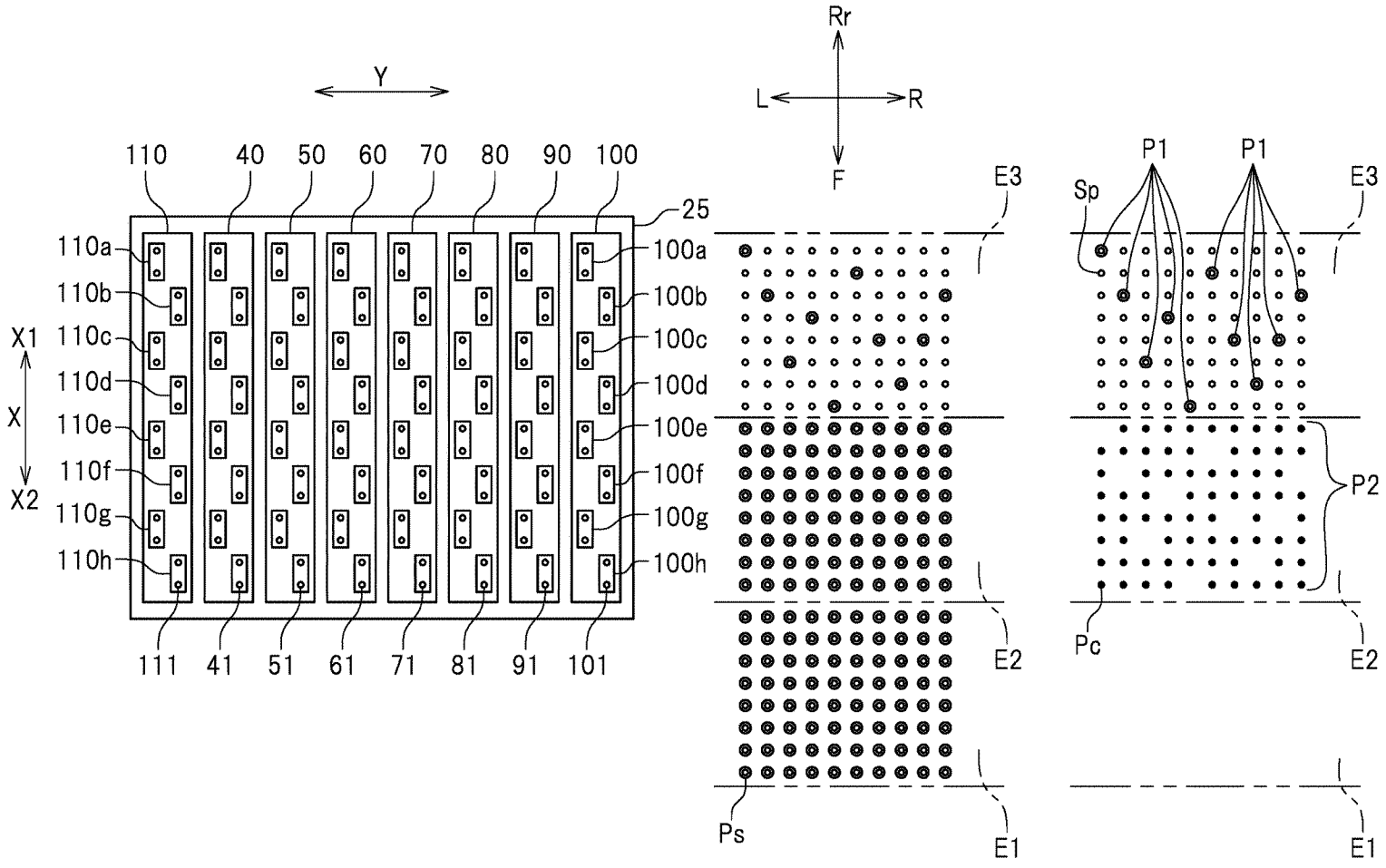
FIG. 6 is a schematic view showing a state at a point in time after, by one pass, the point in time shown in FIG. 5

After the printing mode and the printing ratio are set as described above, the overlapping printing is performed. Hereinafter, a printing process under the printing conditions shown in FIG. 4 will be described. As described above, the printing mode selected in the example shown in FIG. 4 is the "first overlapping printing". The printing conditions shown in FIG. 4 are as follows. For forming the "first printing layer" as the lower layer, the special color ink, about 12.5% of the cyan ink, about 12.5% of the magenta ink, about 25% of the yellow ink, about 12.5% of the black ink, about 12.5% of the gray ink, about 12.5% of the light cyan ink and about 12.5% of the light magenta ink are concurrently printed. For the "second printing layer" as the upper layer, the remaining portion of each color of process color ink is printed. FIG. 5 and FIG. 6 are schematic views showing positions at which the ink lands in the overlapping printing under the above-described conditions. FIG. 5 and FIG. 6 are views of the recording medium 5 as seen from the upper side U. In FIG. 5 and FIG. 6, the bottom side corresponds to the front side F of the printer 10, and the left side corresponds to the left side L of the printer 10. In FIG. 5 and FIG. 6, the recording medium 5 is fed from the upstream side X1 toward the downstream side X2 in the feeding direction X (from the rear side Rr toward the front side F). In FIG. 5 and FIG. 6, circles represent the positions at which the ink has landed. Among the circles, white circles Sp are positions at which the special color ink has landed. Hatched circles Pc are positions at which the process color ink has landed. Double circles Ps are positions at which both of the special color ink and the process color ink have landed. FIG. 6 shows a state of the same positions as those in FIG. 5, at a point in time after, by one pass, the point in time shown in FIG. 5. A left portion of each of FIG. 5 and FIG. 6 shows a state of the recording medium 5 at the corresponding point in time (state in which all of the ink dots printed until the corresponding point in time overlap each other). A right portion of each of FIG. 5 and FIG. 6 shows only the ink dots printed only by the current pass. In FIG. 5 and FIG. 6, the ink dots belonging to the "underlying layer dot groups" are represented by P1, and the ink dots belonging to the "image dot group" are represented by P2.

In FIG. 5 and FIG. 6, the number of the nozzles included in each of the sub ink heads of the first process color ink head 40 through the seventh process color ink head 100 and the sub ink heads of the special color ink head 110 is assumed to be two for the sake of convenience. Therefore, the number of the nozzles included in each ink head is 16. The number of the ink dots that may be arrayed in one line in the scanning direction Y is 10. The number of positions at which the ink may land by one pass is 160. In the schematic views of ink landing in FIG. 5 and FIG. 6, the positions at which the special color ink and one color of process color ink have landed are shown. The process color ink shown in FIG. 5 and FIG. 6 is the light magenta ink. FIG. 5 and FIG. 6 show the position of the carriage 25 in the feeding direction X at the respective point in time.

As shown in FIG. 5, the white ink is ejected from the eight nozzles 111 of the four sub ink heads 110*a*, 110*b*, 110*c* and 110*d* of the special color ink head 110 towards a region E2 of the recording medium 5. Thus, the number of the ink dots Sp made of the special color ink ejected from the nozzles 111 during one pass is 80. Among the sub ink heads of the special color ink head 110, the sub ink heads 110*a*, 110*b*, 110*c* and 110*d* are located in half of the region of the special color ink head 110 on the upstream side X1 in the feeding direction X. Concurrently, about 12.5% of all of the amount of the light magenta ink (seventh underlying layer dot group P1) is ejected from the nozzles 101 of the four sub ink heads 100*a*, 100*b*, 100*c* and 100*d* of the seventh process color ink head 100 towards the region E2. Among the sub ink heads of the seventh process color ink head 100, the sub ink heads 100*a*, 100*b*, 100*c* and 100*d* are located in half of the region of the seventh process color ink head 100 on the upstream side X1 in the feeding direction X. The number of the ink dots that is able to be made of the light magenta ink ejected from the nozzles 101 of the four sub ink heads 100*a*, 100*b*, 100*c* and 100*d* of the seventh process color ink head 100 during one pass is 80, as in the case of the special color ink. The nozzles 101 eject ink to print 10 dots, which is about 12.5% of the 80 ink dots. Thus, 10 out of 80 positions at which the ink may land in the region E2 are represented by double circles Ps. At the point in time shown in FIG. 5, the "first printing layer" has been provided in the region E2. A region E1 shown in FIG. 5 is downstream with respect to the region E2 of the recording medium 5. Namely, the region E1 is advanced by one pass with respect to the region E2. As shown in the right portion of FIG. 5, towards the region E1, the process color ink of the seventh image dot group P2 (ink defining ink dots remaining after the ink dots for the seventh underlying layer dot group P1 are provided) is ejected from the nozzles 101 of the four sub ink heads 100*e*, 100*f*, 100*g* and 100*h* of the seventh process color ink head 100. Namely, ink defining 70 dots Pc of the light magenta ink is ejected toward the region E1 from the nozzles 101 of the four sub ink heads 100*e*, 100*f*, 100*g* and 100*h* of the seventh process color ink head 100. Among the sub ink heads of the seventh process color ink head 100, the sub ink heads 100*e*, 100*f*, 100*g* and 100*h* are located in half of the region of the seventh process color ink head 100 on the downstream side X2 in the feeding direction X. In the region E1 shown in FIG. 5, the "second printing layer" has been printed over the "first printing layer". After the ejection is performed to print the "second printing layer", all of the positions in the region E1 are in the double circle Ps state.

FIG. 6 shows the state at a point in time after, by one pass, the point in time shown in FIG. 5. The printing on the region E1 of the recording medium 5 has been finished, and the region E1 has been fed on the downstream side X2 in the feeding direction X with respect to the ink heads. At the point in time shown in FIG. 6, the ejection is performed toward the region E2 in the same or substantially the same manner as the ejection performed toward the region E1 at the point in time shown in FIG. 5. Namely, the light magenta ink of the seventh image dot group P2 is ejected from the nozzles 101 of the sub ink heads 100*e*, 100*f*, 100*g* and 100*h* of the seventh process color ink head 100 towards the region E2. At the point in time shown in FIG. 6, the printing on the region E2 has been finished. At the point in time shown in FIG. 6, the ejection is performed towards a region E3, which is on the upstream side X1 in the feeding direction X with respect to the region E2, in the same or substantially the same manner as the ejection performed towards the region E2 at the point in time shown in FIG. 5. Namely, towards the region E3, the white ink is ejected from the nozzles 111 of the sub ink heads 110*a*, 110*b*, 110*c* and 110*d* of the special color ink head 110, and also ink providing 10 dots of the light magenta ink that define the seventh underlying layer dot group P1 is ejected from the nozzles 101 of the sub ink heads 100*a*, 100*b*, 100*c* and 100*d* of the seventh process color ink head 100.

The process color ink other than the light magenta ink is ejected in substantially the same manner as the light magenta ink. This will be described more specifically. At the point in time shown in FIG. 5, about 12.5% of all the amount of the cyan ink is ejected toward the region E2 from the nozzles 41 of the four sub ink heads, on the upstream side, of the first process color ink head 40. About 12.5% of all of the amount of the magenta ink is ejected towards the region E2 from the nozzles 51 of the four sub ink heads, on the upstream side, of the second process color ink head 50.

About 25% of all of the amount of the yellow ink is ejected towards the region E2 from the nozzles 61 of the four sub ink heads, on the upstream side, of the third process color ink head 60. About 12.5% of all of the amount of the black ink is ejected towards the region E2 from the nozzles 71 of the four sub ink heads, on the upstream side, of the fourth process color ink head 70. About 12.5% of all of the amount of the gray ink is ejected towards the region E2 from the nozzles 81 of the four sub ink heads, on the upstream side, of the fifth process color ink head 80. About 12.5% of all of the amount of the light cyan ink is ejected towards the region E2 from the nozzles 91 of the four sub ink heads, on the upstream side, of the sixth process color ink head 90. Towards the region E1, the process color ink of the image dot group (ink defining ink dots remaining after the ink dots for the underlying layer dot group are provided) is ejected from the nozzles of the four sub ink heads, on the downstream side, of each process color ink head. In this manner, the printer 10 according to the present preferred embodiment continuously performs the "first overlapping printing".

In the "second overlapping printing", the upper layer and the lower layer are opposite to those of the "first overlapping printing". In the "second overlapping printing", the "second printing layer" is provided as the lower layer, and the "first printing layer" is provided as the upper layer. In the "second overlapping printing", the order in which the "first printing layer" and the "second printing layer" are provided is opposite at the same positions on the recording medium 5. In the "second overlapping printing", each color of process color ink of the "image dot group" is ejected from the nozzles of the sub ink heads on the upstream side, and each color of process color ink and the special color ink of the "underlying layer dot group" are ejected from the nozzles of the sub ink heads on the downstream side.

As described above, the printer 10 according to the present preferred embodiment generates the "underlying layer dot group" and the "image dot group" of the ink dots of each color of process color ink, and prints the "first printing layer" of the ink dots of the "image dot groups" of the plurality of colors of process color ink and the ink dots of the special color ink. The printer 10 further prints the "second printing layer" of the ink dots of the "image dot groups" of the plurality of colors of process color ink, above or below the "first printing layer". A portion of the image is mixed in the underlying color layer, and another portion of the image is printed as overlapping the underlying color layer. In this manner, the image provided even by the overlapping printing is able to appear to be three-dimensional. The printer 10 according to the present preferred embodiment provides an image that appears to be deeper and more massive than by the overlapping printing performed using the conventional printer. In addition, the printer 10 according to the present preferred embodiment generates the "underlying layer dot group" and the "image dot group" independently for each color of process color ink. Therefore, the image quality is adjusted based on each color of process color ink, and a desired color balance is obtained even by the overlapping printing.

The controller 200 in the present preferred embodiment includes the ratio setter 204 setting the ratios of the "underlying layer dot group" and the "image dot group" with respect to the entirety of the ink dots of each color of process color ink. The generator 202 generates the "underlying layer dot group" and the "image dot group" such that the ratios thereof with respect to the entirety of each color of process color ink are the same or substantially the same as the ratios set by the ratio setter 204. The ratio setter 204 sets the ratios, so that the quality of the resultant printed image is adjusted based on each color of process color ink.

To the ratio input portion 205, the ratios of the "underlying layer dot group" and the "image dot group" with respect to the entirety of the ink dots of each color of process color ink are input. Each of the ratio setters 204*a* through 204*g* sets the ratios of the "underlying layer dot group" and the "image dot group" with respect to the entirety of the ink dots of the corresponding color of process color ink in accordance with the input ratios. As a result, the operator may adjust how much of each color of process color ink is to be mixed in the underlying color layer while checking the quality of the printed image.

The ratio of the "underlying layer dot group" of each color of process color ink with respect to the entirety of the ink dots is preferably set to about 0.5% or higher and lower than about 50%, for example. In the case in which the ratio is set to about 0.5% or higher and lower than about 50%, for example, the effect of causing the resultant image to appear to have depth and massiveness is provided. The ratio is more preferably about 10% to about 20%, for example.

The printer 10 according to the present preferred embodiment includes the mode selector 201. The mode selector 201 allows either one of the "first overlapping printing" and the "second overlapping printing" to be selected as a mode of overlapping printing. The "first overlapping printing" is a printing mode of providing the "first printing layer" as the lower layer and providing the "second printing layer" as the upper layer. The "second overlapping printing" is a printing mode of providing the "second printing layer" as the lower layer and providing the "first printing layer" as the upper layer. Since the mode selector 201 is included, the printer 10 according to the present preferred embodiment is usable for either the "first overlapping printing" or the "second printing layer".

As described above, the printer 10 according to the present preferred embodiment includes the interfaces to which the operator may input the printing mode and the printing ratios. The printer 10 does not need to include the interfaces. For example, the printing data may include the printing mode and the printing ratios, so that the printing mode and the printing ratios are automatically set. The interfaces do not need to be in the layout shown in FIG. 4. For example, the interfaces may include volume button indicators or other suitable interfaces, instead of the input boxes B1 through B7. The interfaces may each be a tool by which a color developing level such as "clear", "normal" "blurred" or other suitable levels may be selected. In this case, the printing ratios corresponding to such various levels are preferable preset in the controller 200.

In the present preferred embodiment, the printing process of a one pass mode has been described, by which after printing is performed for one pass, the recording medium 5 is moved in the feeding direction X by the same length as the length by which the printing has been performed. The printing mode is not limited to the one pass mode. Another usable printing mode is, for example, interlace printing (overlapping printing), by which after printing is performed for one pass, the recording medium 5 is moved by a predetermined distance that is shorter than the length by which the printing has been performed, so that an image is provided by performing printing for a plurality of passes.

Preferred Embodiment 2

In preferred embodiment 2 of the present invention, the ratios of the "underlying layer dot group" and the "image dot group" of each color of process color ink are automatically determined by the ratio setter 204. Therefore, the printer 10 according to preferred embodiment 2 is different from the printer according to preferred embodiment 1 with respect to the specifications of the ratio setter 204. In addition, the printer 10 according to preferred embodiment 2 does not include the ratio input portion 205. Except for these points, the printer 10 according to preferred embodiment 2 preferably is the same or substantially the same as the printer 1 according preferred embodiment 1. In the description of preferred embodiment 2, the components that are same as those of preferred embodiment 1 will be denoted by the same reference signs, and overlapping descriptions will be omitted or simplified. This is also applicable to preferred embodiment 3.

The ratio setter 204 according to the present preferred embodiment includes a matrix corresponding to the colors of process color ink and the types of the recording medium. More specifically, the "underlying layer printing ratio" is preset for each of colors of process color ink and each of the types of recording medium in the matrix.

FIG. 7 shows an example of the matrix. The matrix shown in FIG. 7 is merely an example, and does not limit the technology disclosed herein in any way. In the matrix shown in FIG. 7, different colors of process color ink are shown in the column direction. In the matrix shown in FIG. 7, there are seven colors of process color ink (cyan ink, magenta ink, yellow ink, black ink, gray ink, light cyan ink, and light magenta ink) as in preferred embodiment 1. The matrix may define the underlying layer printing ratio for another color of process color ink. In the matrix shown in FIG. 7, various types of recording medium are shown in the row direction. In the matrix shown in FIG. 7, there are preferably four types of recording medium of A, B, C and D, for example. The types of recording medium are not limited to these four types. The underlying layer printing ratio in each of combinations of the process color ink and the recording medium is defined in the corresponding box in the matrix. Based on the matrix, the first ratio setter 204*a* through the seventh ratio setter 204*g* each set the respective underlying layer printing ratio.

The matrix as shown in FIG. 7 is set in consideration of the color developing property, the brightness, and the wettability for the recording medium of the process color ink. More specifically, the underlying layer printing ratio is preferably set to be higher as the color developing property of the process color ink is lower. The underlying layer printing ratio is preferably set to be higher as the brightness of the process color ink is higher. The underlying layer printing ratio is preferably set to be higher as the wettability of the process color ink for the recording medium 5 is lower.

Process color ink having a low color developing property is low in the ink concentration. Process color ink having a low ink concentration has a low ratio (e.g., % by weight) of color material in the ink. Therefore, the underlying layer printing ratio is preferably set to be higher as the ratio of the color material in the process color ink is lower, and the underlying layer printing ratio is preferably set to be lower as the ratio of the color material in the process color ink is higher. Among the various colors of process color ink in the present preferred embodiment, the light cyan ink and the light magenta ink have a low color developing property.

Process color ink having a low color developing property (low ink concentration) is relatively inconspicuous when being ejected as being mixed in the special color ink. Therefore, it is preferable to mix a relatively large amount of such process color ink when such process color ink is used to print concurrently with the special color ink. The printer 10 according to the present preferred embodiment ejects the process color ink having a low color developing property at a higher underlying layer printing ratio than that of the process color ink having a high color developing property. Namely, a larger amount of process color ink having a low color developing property is ejected for the "first printing layer". As a result, an image appearing to have massiveness is able to be printed.

Process color ink having a high brightness is of a bright color. Among the various colors of process color ink in the present preferred embodiment, yellow ink has a high brightness.

Process color ink having a high brightness is also relatively inconspicuous when being ejected as being mixed in the special color ink. Therefore, it is preferable to mix a relatively large amount of such process color ink when such process color ink is used to print concurrently with the special color ink. The printer 10 according to the present preferred embodiment ejects the process color ink having a high brightness at a higher underlying layer printing ratio than that of the process color ink having a low brightness. Namely, a larger amount of process color ink having a high brightness is ejected for the "first printing layer". As a result, an image appearing to have massiveness is able to be printed.

The wettability of the process color ink for the recording medium varies in accordance with the combination of the process color ink and the recording medium. Process color ink having a low wettability for a certain type of recording medium 5 does not expand very much when landing on the recording medium 5. Regarding the recording mediums A, B and C shown in FIG. 7, preferably, the underlying layer printing ratio is set to be lowest for the recording medium A, and is set to be second lowest for the recording medium B, for the same color of process color ink. The underlying layer printing ratio is preferably set to be highest for the recording medium C among the recording mediums A through C. Namely, among the three types of recording mediums A through C, the recording medium A is wetted most easily by the ink, and the recording medium B is wetted second most easily by the ink. Among the three types of recording mediums, the recording medium C is most difficult to be wetted by the ink. This order may vary in accordance with the color of process color ink. For the recording medium D, the same or substantially the same underlying layer printing ratio is preferably set for all the colors of process color ink registered. There may be a recording medium, such as the recording medium D, for which the same or almost the same underlying layer printing ratio may be set regardless of the color of process color ink.

Figure 8:
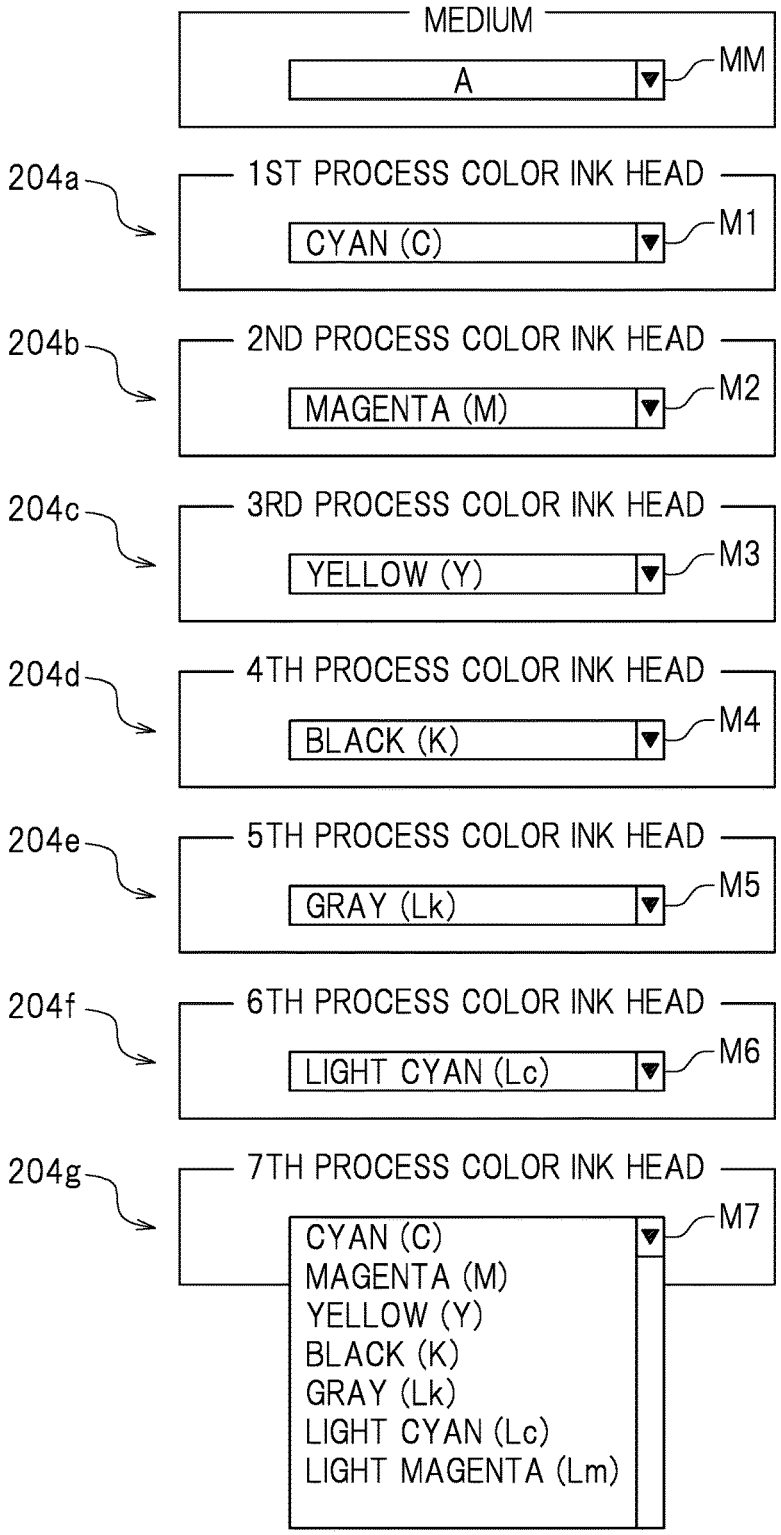
FIG. 8 shows an example of interfaces by which the color of process color ink to be ejected from each of process color ink heads and the type of recording medium may be set.

As described above, the ratio setter 204 in preferred embodiment 2 automatically sets the underlying layer printing ratio of each color of process color ink based on the color developing property, the brightness and the wettability for the recording medium of the process color ink. It should be noted that the ratio setter 204 may include interfaces by which the color of ink to be ejected from each of the first process color ink head 40 through the seventh process color ink head 100, and the type of recording medium, may be set. FIG. 8 shows an example of such interfaces. As shown in FIG. 8, the first ratio setter 204*a* through the seventh ratio setter 204*g* respectively include ink setting menus M1 through M7. In each of the ink setting menus M1 through M7 in the present preferred embodiment, cyan ink, magenta ink, yellow ink, black ink, gray ink, light cyan ink and light magenta ink are registered. One color of process color ink may be selected from these colors of process color ink. The operator selects the color of ink using the ink setting menus M1 through M7, so that the first underlying layer printing ratio through the seventh underlying layer printing ratio are set. The settings are maintained unless changes are made. The interfaces shown in FIG. 8 include a medium setting menu MM, by which the type of recording medium is selected. In the medium setting menu MM, the recording mediums A, B, C and D, for example, are registered.

In a modification of preferred embodiment 2, the method of setting the underlying layer printing ratios may preferably be selected from an "automatic mode" and a "manual mode". In the "automatic mode", the ratio setter 204 automatically sets the underlying layer printing ratios as in preferred embodiment 2. In the "manual mode", the operator inputs the underlying layer printing ratios to the ratio input portion 205 as in preferred embodiment 1. In this modification, the underlying layer printing ratios may be set in either the "automatic mode" or the "manual mode" selected by the operator.

Preferred Embodiment 3

Figure 9:
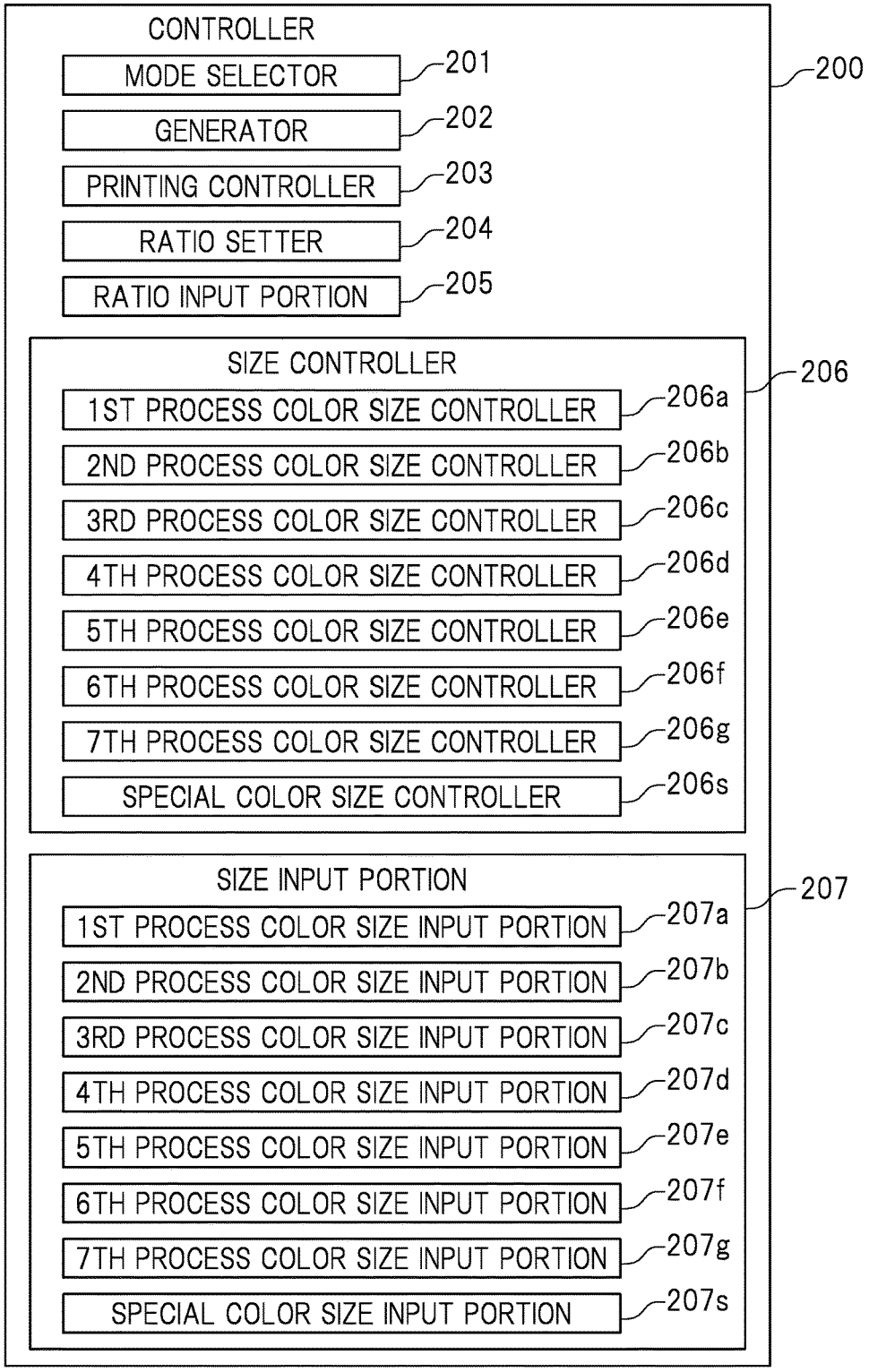
FIG. 9 is a block diagram of a controller according to preferred embodiment 3 of the present invention.

In preferred embodiment 3 of the present invention, the printer 10 is configured such that the ink dots of the special color ink and the ink dots of the "underlying layer dot groups" each have an adjustable dot size. In the present preferred embodiment, the ink dots of different colors of ink may have different sizes from each other. FIG. 9 is a block diagram of the controller 200 in the present preferred embodiment. As shown in FIG. 9, the controller 200 in the present preferred embodiment includes a size controller 206 that controls the dot size of the special color ink and the dot size of each of the "underlying layer dot groups", and a size input portion 207, to which the dot size of each color of ink may be input. The size controller 206 includes a first process color size controller 206*a* through a seventh process color size controller 206*g* and a special color size controller 206*s*. The first process color size controller 206*a* through the seventh process color size controller 206*g* are respectively connected with the actuators 43 through 103 provided in the first process color ink head 40 through the seventh process color ink head 100, and control the dot sizes of the respective colors of process color ink to be ejected from the respective ink heads. The special color size controller 206*s* is connected with the actuators 113 provided in the special color ink head 110, and controls the dot size of the special color ink to be ejected from the special color ink head 110. Herein, the "first process color size controller" refers to the size controller for the "first process color", and this is also applicable to the other size controllers.

The size input portion 207 includes a first process color size input portion 207*a* through a seventh process color size input portion 207*g* and a special color size input portion 207*s*. The first process color size input portion 207*a* through the seventh process color size input portion 207*g* are respectively connected with the first process color size controller 206*a* through the seventh process color size controller 206*g*. The first process color size controller 206*a* through the seventh process color size controller 206*g* of the size controller 206 control the dot sizes of the ink to be ejected from the respective ink heads to provide the "underlying layer dot groups", such that the dot sizes of the ink dots are the same or substantially the same as the dot sizes of the ink dots input to the first process color size input portion 207*a* through the seventh process color size input portion 207*g*. The special color size controller 206*s* controls the dot size of the special color ink to be ejected from the special color ink head 110 such that the dot size is the same or substantially the same as the dot size input to the special color size input portion 207*s*. Herein, the "first process color size input portion" refers to the size input portion for the first process color, and this is also applicable to the other input portions.

Figure 10A:
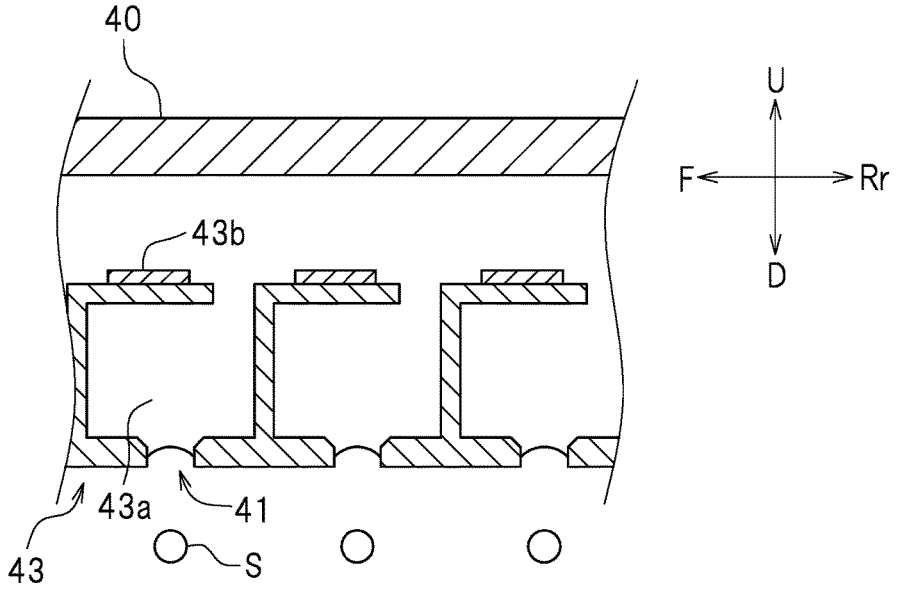
FIG. 10A is a schematic view showing a state in which S-sized ink drops are ejected from nozzles of a first process color ink head.
Figure 10B:
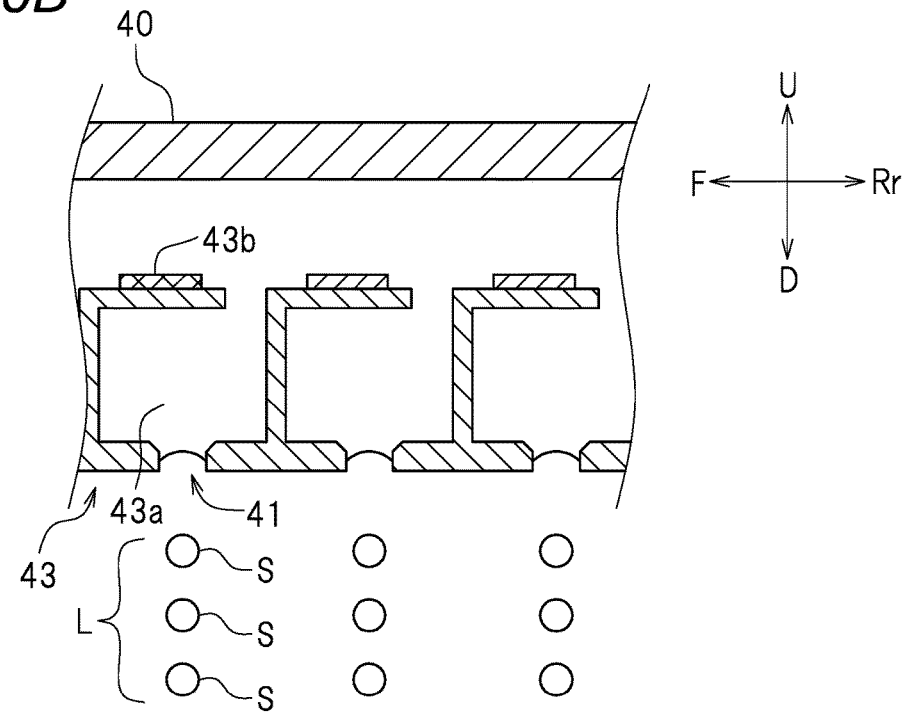
FIG. 10B is a schematic view showing a state in which L-sized ink drops are ejected from the nozzles of the first process color ink head.

FIG. 10A and FIG. 10B are schematic views of the nozzles of one ink head and the vicinity thereof. The actuators include the same mechanism in all of the ink heads. Thus, the control on the dot size will be described regarding the first process color ink head 40 with reference to FIG. 10A and FIG. 10B. The first process color size controller 206*a* is connected with the piezoelectric elements 43*b* of the first process color actuators 43 provided in the first process color ink head 40. The first process color size controller 206*a* controls the driving of the piezoelectric elements 43*b* to control the dot size of the ink to be ejected from each of the nozzles 41 of the first process color ink head 40. The control on the dot size by the first process color size controller 206*a* may preferably be performed on a nozzle-by-nozzle basis, namely, on a piezoelectric element 43*b*-by-piezoelectric element 43*b* basis. This is also applicable to the second process color ink head 50 through the seventh process color ink head 100 and the special color ink head 110.

The first process color size controller 206*a* and the first process color actuators 43 in the present preferred embodiment may preferably adjust the dot size of the ink to be ejected to any of three dot sizes of S, M and L. Among the three sizes, the S size is a basic size. An ink dot having the S size has the smallest volume. An ink dot having the M size has the next smallest volume. The volume of the ink dot having the M size is, for example, twice the volume of the ink dot having the S size. An ink dot having the L size has the largest volume. The volume of the ink dot having the L size is, for example, three times the volume of the ink dot having the S size. In the present preferred embodiment, there are three dot sizes. There may be four or more dot sizes, or there may be two dot sizes. It is not necessary that the volume of one size is twice or three times the volume of another size.

In many cases, image data includes size data on the three ink dot sizes of S, M and L beforehand. In the size data, the S-sized ink dots, the M-sized ink dots, and the L-size ink dots are included in a mixed state. The size data is changed using the first process color size input portion 207*a* through the seventh process color size input portion 207*g* and the special color size input portion 207*s*, so that the dot size of the "underlying layer dot group" of each color of process color ink and the dot size of the special color ink are set.

FIG. 10A shows a state in which S-sized ink drops S are ejected from the nozzles 41 of the first process color ink head 40. The pressure chambers 43*a* are contracted once by the displacement of the piezoelectric elements 43*b*, so that the ink drops S are ejected. Namely, the volume of each of the ink drops S matches a decrease in the volume of the pressure chamber 43*a* that is caused by the pressure chamber 43*a* being contracted once. FIG. 10B shows a state where L-sized ink drops L are ejected from the nozzles 41 of the first process color ink head 40. As shown in FIG. 10B, the first process color actuators 43 cause the nozzles 41 to eject three S-sized ink drops S. This is achieved by the ejection being performed three times with a very short time interval. Therefore, the three ink drops S land at the same or substantially the same position although the carriage 25 moves. As a result of the three ink drops S landing at the same or substantially the same position, an L-sized ink drop L having a volume three times the volume of an S-sized ink drop S is provided. In this manner, the first process color size controller 206*a* and the first process color actuators 43 adjust the dot size of the ink to be ejected to a predetermined size. This is also applicable to the second process color ink head 50 through the seventh process color ink head 100 and the special color ink head 110.

Figure 11:
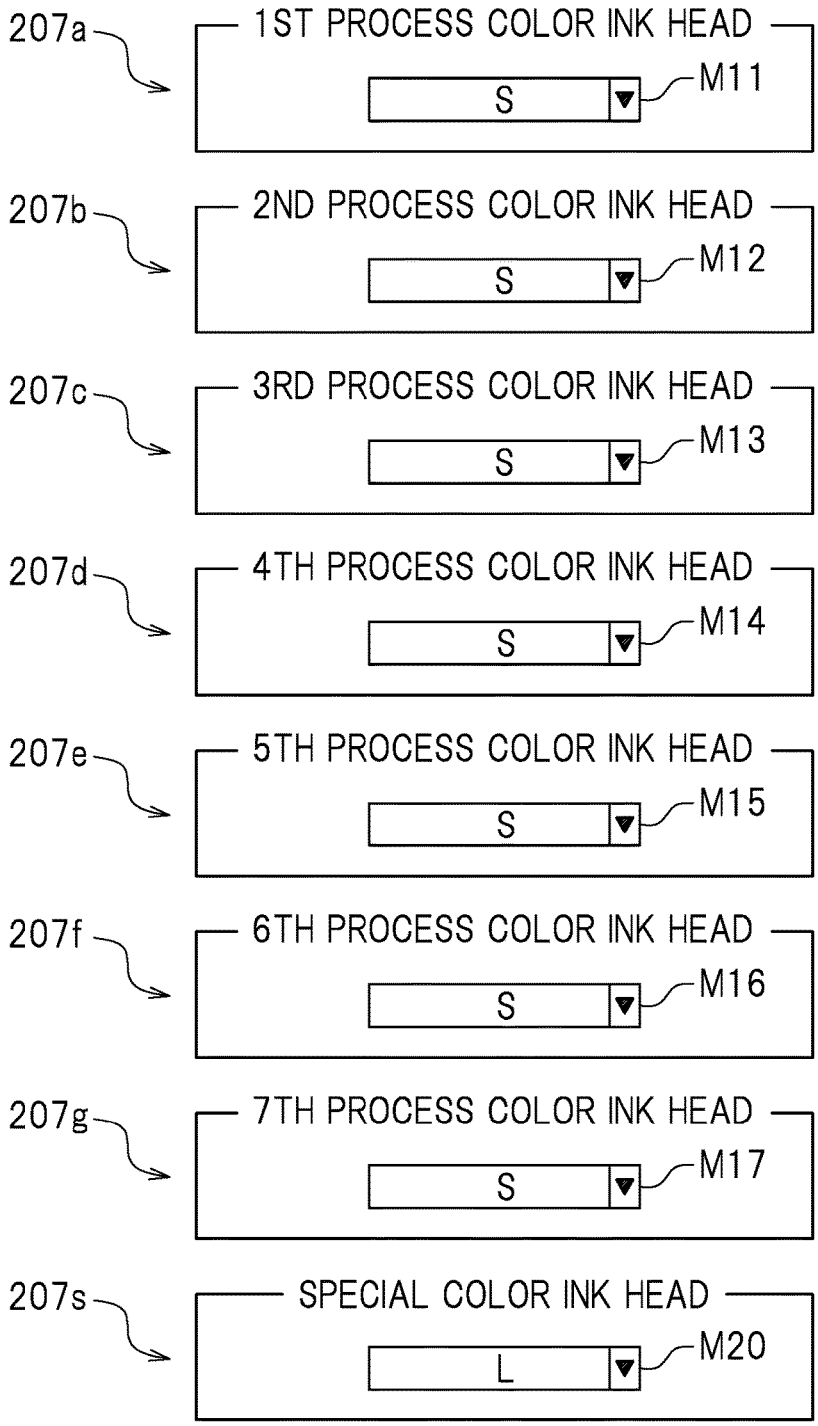
FIG. 11 shows an example of interfaces in preferred embodiment 3 of the present invention.

FIG. 11 shows an example of interfaces in the present preferred embodiment. As shown in FIG. 11, the first process color size input portion 207*a* through the seventh process color size input portion 207*g* and the special color size input portion 207*s* are displayed on the interfaces respectively as a first size selection menu M11 through the seventh size selection menu M17 and a special color size selection menu (size selection menu for the special color) M20. The first size selection menu M11 through the seventh size selection menu M17 are each an interface to which the dot size of the ink to be ejected from each of the first process color ink head 40 through the seventh process color ink head 100 to provide the "underlying layer dot group" may be input. The special color size selection menu M20 is an interface to which the dot size of the special color ink to be ejected from the special color ink head 110 may be input. In the present preferred embodiment, the three dot sizes of S, M and L are registered in each of the size selection menus. The operator may select any one of the dot sizes S, M and L.

The printer 10 according to the present preferred embodiment includes the size controller 206 adjusting the dot size of the ink to be ejected from each of the ink heads and the size input portion 207, to which the dot size of the "underlying layer dot group" of each color of process color ink and the dot size of the special color ink, may be input. Thus, the printer 10 according to the present preferred embodiment further improves the degree of freedom in adjusting the quality of the printed image. In the case in which, for example, the dot size of each of the "underlying layer dot groups" is adjusted to be smaller than the dot size of the special color ink, the image mixed in the underlying color layer is able to appear to be natural in a finished state. By contrast, in the case in which the dot size of each of the "underlying layer dot groups" is adjusted to be larger than the dot size of the special color ink, the image mixed in the underlying color layer is able to appear conspicuous and present a stronger visual effect.

The size input portion 207 in the interfaces does not need to be in the configuration shown in FIG. 11. For example, the size input portion 207 may preferably allow the color developing level to be selected from, for example, "clear", "normal" "blurred" and other suitable levels. In this case, the dot size corresponding to each color developing level is automatically selected. The above-described method of controlling the dot size by the size controller 206 is an example. The method of controlling the dot size is not limited to the above-described method.

Some preferred embodiments of the present invention have been described. The above-described preferred embodiments are merely examples, and the technology disclosed herein may be provided and performed in any of various configurations and arrangements.

In the above-described preferred embodiments, the sum of the ratios of the "underlying layer dot group" and the "image dot group" is preferably 100% of the entirety of the ink dots of each color of process color ink. Alternatively, there may be ink dots that are included in both of the "underlying layer dot group" and the "image dot group", so that the sum of the ratios of the two groups may exceed 100% with respect to the entirety of the ink dots of the process color ink. In an image printed in this case, such overlapping ink dots are able to make the image clearer than the image in the case in which the sum of the ratios is 100%. In the case in which the overlapping printing is performed such that the final ink amount exceeds 100% of the ink dots of the process color ink, the range of colors that may be represented by the same printer using the same colors of ink (color gamut) is extended. Based on the knowledge of the inventor of preferred embodiments of the present invention, preferred overlapping printing is performed in the case in which, for example, about 10% to about 20% of the ink dots of each color of process color ink is assigned to the "underlying layer dot group" and about 100% of the ink dots of each color of process color ink is assigned to the "image dot group".

According to the "overlapping printing" in the above-described preferred embodiments, two layers, namely, a lower layer and an upper layer, are preferably provided in an overlapping state. Alternatively, three or more layers may be provided in an overlapping state. For example, three layers of an underlying color layer, an image layer, and a top coat may be provided in an overlapping state. In this case, the top coat may be made of, for example, transparent ink. In the case in which three or more layers are generated in an overlapping state, three or more dot groups may be generated of the ink dots of each color of the process color ink, not only the "underlying layer dot group" and the "image dot group".

In preferred embodiment 3 described above, the controller 200 includes the size input portion 207 to control the dot size of the ink. The size control may not be performed based on an input to the size input portion 207. For example, the dot sizes may be automatically selected by the size controller 206. Alternatively, the dot sizes of the "underlying layer dot groups" of all of the colors of process color ink and the special color ink may be set to be the same or substantially the same size. In the case in which the dot sizes of the "underlying layer dot groups" of all of the colors of process color ink and the special color ink are set to be the same or substantially the same size, the image processing is simpler and the control is easier.

In the printer 10 according to preferred embodiment 3, in which the dot size of the ink to be ejected from each ink head is selected from the predefined sizes, the smallest size among the available sizes may be selected as the dot size of the "underlying layer dot group" of each color of process color ink and the dot size of the special color ink. In the case in which the dot size of the "underlying layer dot group" of each color of process color ink and the dot size of the special color ink are set to be the smallest size, the printed image is expected to appear to be natural.

In the above-described preferred embodiments, the ink dots belonging to each of the "underlying layer dot groups" are extracted randomly. The extraction method is not limited to this. For example, some statistical technique may be used for the extraction.

In the above-described preferred embodiments, the process color ink heads 40 through 100 and the special color ink head 110 each preferably include a plurality of sub ink heads, and the sub ink heads are located in a staggered arrangement in two lines in the corresponding ink head. The positional arrangement of the sub ink heads in each ink head is not limited to the above-described arrangement. The sub ink heads may be arrayed as shown in, for example, FIG. 12. In the positional arrangement shown in FIG. 12 as seen at the bottom surface of the carriage 25, the sub ink heads are arrayed in one line in the feeding direction X.

Figure 12:
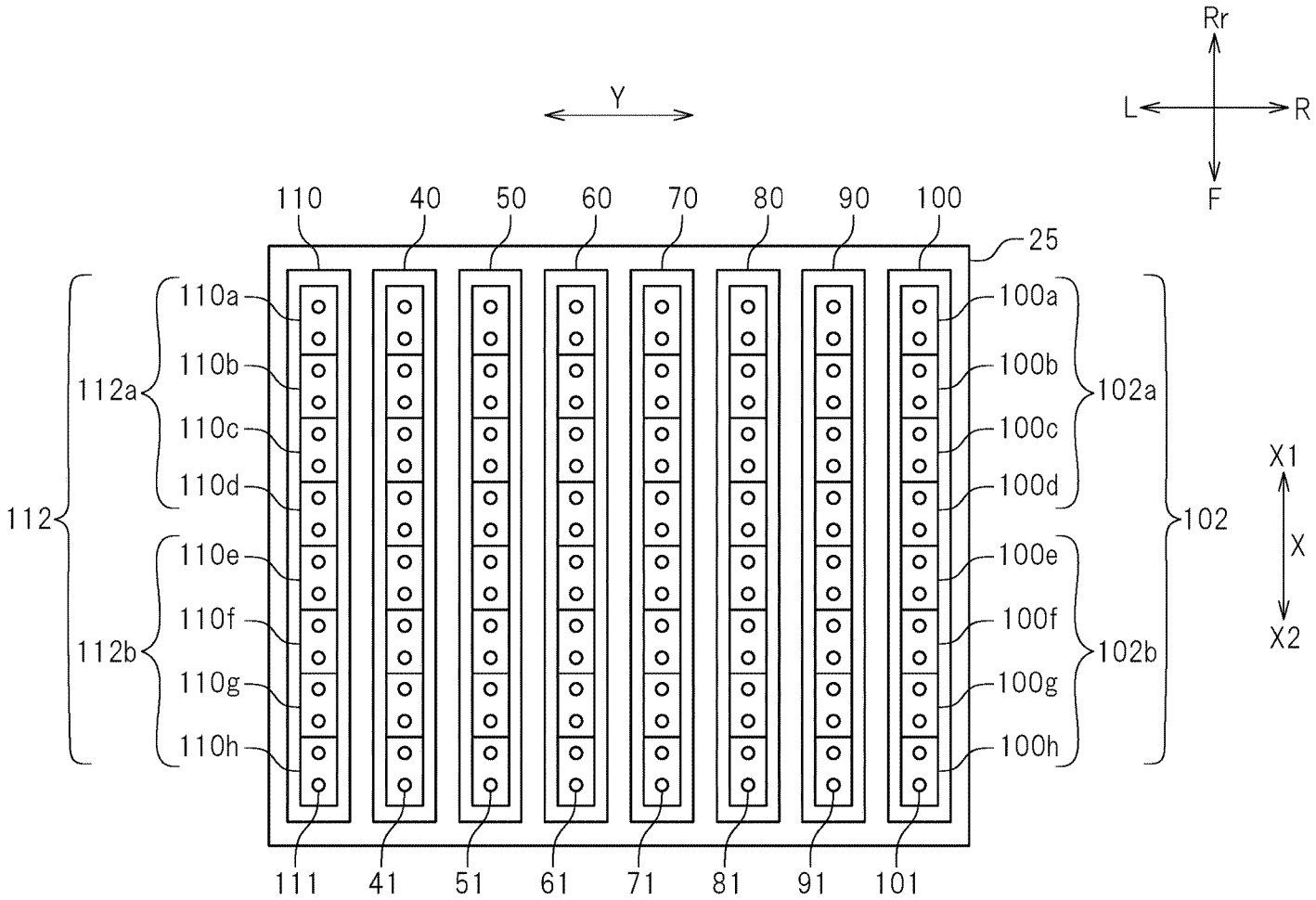
FIG. 12 is a schematic view showing a structure of a bottom surface of a carriage different from the carriage according to preferred embodiments 1 through 3 of the present invention.

In the preferred embodiment shown in FIG. 12, the special color ink head 110 preferably includes the sub ink heads 110*a* through 110*h* arrayed in one line in the feeding direction X. The plurality of nozzles 111 included in each of the sub ink heads 110*a* through 110*h* are arrayed in the feeding direction X. Therefore, the nozzle 111 in all of the sub ink heads 110*a* through 110*h* define a nozzle array 112 extending in one line in the feeding direction X. The nozzle array 112 is divided into a special color upstream nozzle array 112*a* located on the upstream side X1 in the feeding direction X and a special color downstream nozzle array 112*b* located on the downstream side X2 in the feeding direction X. The special color upstream nozzle array 112*a* includes the nozzles 111 in the four sub ink heads 110*a*, 110*b*, 110*c* and 110*d* located on the upstream side X1 in the feeding direction X. The special color downstream nozzle array 112*b* includes the nozzles 111 in the four sub ink heads 110*e*, 110*f*, 110*g* and 110*h* located on the downstream side X2 in the feeding direction X. The number of the nozzles 111 in the special color upstream nozzle array 112*a* and the number of the nozzles 111 in the special color downstream nozzle array 112*b* are preferably equal or substantially equal to each other. The special color upstream nozzle array 112*a* and the special color downstream nozzle array 112*b* are distinguished as described above for the purpose of control, and do not have any structural differences. Herein, the "special color upstream nozzle array" refers to the upstream nozzle array for the special color, and this is applicable to the other upstream nozzle arrays. The "special color downstream nozzle array" refers to the downstream nozzle array for the special color, and this is applicable to the other downstream nozzle arrays.

In the preferred embodiment shown in FIG. 12, the process color ink heads 40, 50, 60, 70, 80, 90 and 100 each preferably include a plurality of sub ink heads arrayed in one line in the feeding direction X. The positional arrangement of the sub ink heads and the nozzles in the process color ink heads 40 through 100 is the same or substantially the same as that of the special color ink head 110. In, for example, the seventh process color ink head 100, the nozzles 101 preferably define a nozzle array 102 extending in one line in the feeding direction X. The nozzle array 102 is divided into a seventh process color upstream nozzle array 102*a* located on the upstream side X1 in the feeding direction X and a seventh process color downstream nozzle array 102*b* located on the downstream side X2 in the feeding direction X. The seventh process color upstream nozzle array 102*a* and the seventh process color downstream nozzle array 102*b* preferably have the same or substantially the same length with each other in the feeding direction X. This is also applicable to the nozzles in the other process color ink heads. The nozzles in the process color ink heads 40 through 100 are located at positions matching, in the feeding direction X, those of the nozzles 111 in the special color ink head 110.

Figure 13:
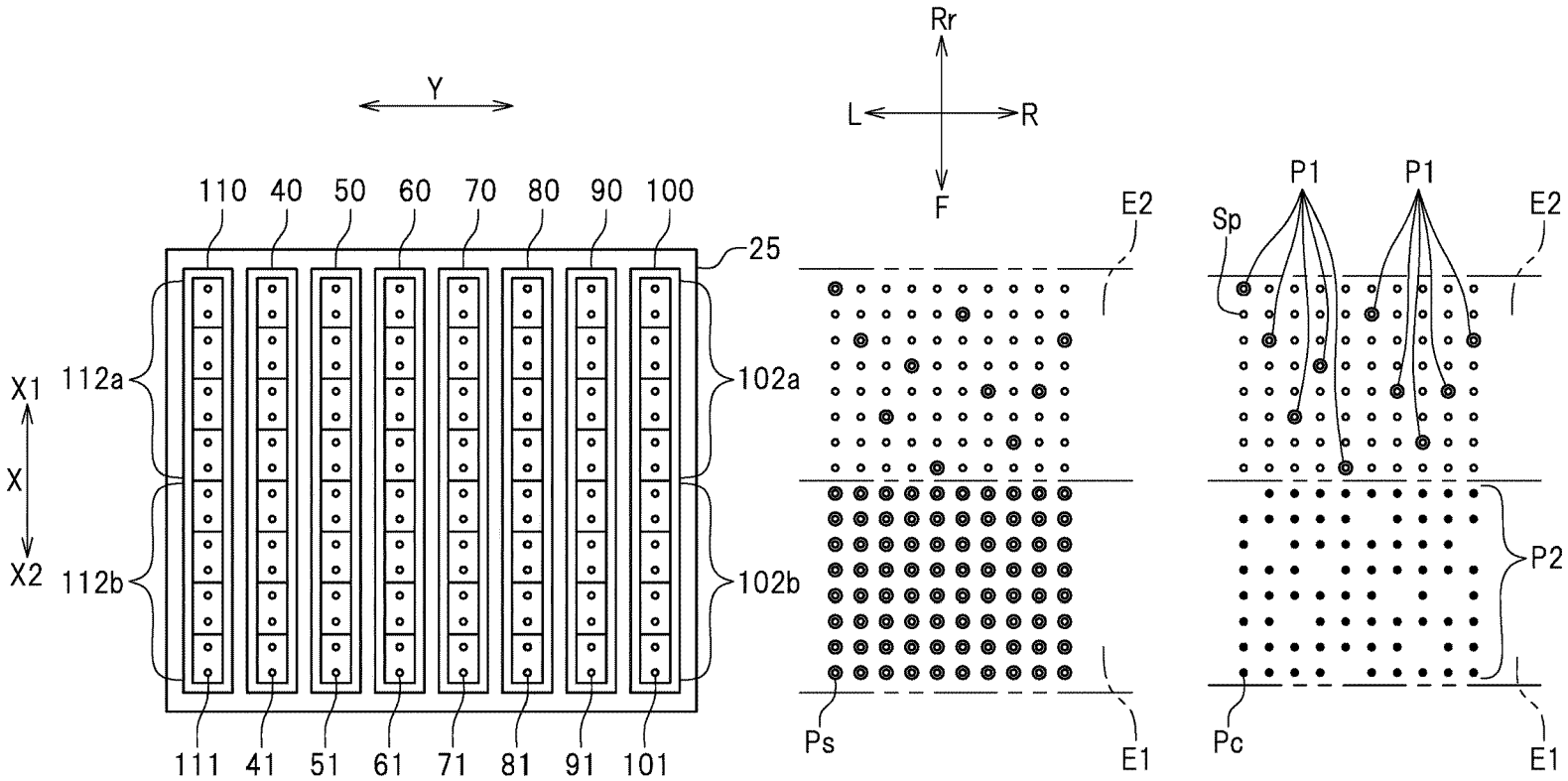
FIG. 13 is a schematic view showing positions at which the ink lands in overlapping printing performed by a printer shown in FIG. 12.

FIG. 13 is a schematic view showing positions at which the ink lands in the overlapping printing performed by the printer 10 shown in FIG. 12. The printing conditions in FIG. 13 are the same or substantially the same as those in FIG. 5 and FIG. 6. FIG. 13 shows a state at the same point in time as that of FIG. 5. As in FIG. 5, FIG. 13 shows only the ink dots of the light magenta ink as the ink dots of the process color ink. A left portion of FIG. 13 shows a state in which all of the ink dots that have landed until the corresponding point in time overlap each other. A right portion of FIG. 13 shows only the ink dots that have landed only by the current pass. The reference signs and the symbols used in FIG. 13 are the same or substantially the same as those in FIG. 5.

As shown in FIG. 13, white ink is ejected from the nozzles 111 of the special color ink upstream nozzle array 112*a* towards the region E2 of the recording medium 5. Concurrently, about 12.5% of all of the amount of the light magenta ink (seventh underlying layer dot group P1) is ejected from the seventh process color upstream nozzle array 102*a* toward the region E2. At the point in time shown in FIG. 13, the "first printing layer" has been provided in the region E2.

The region E1 shown in FIG. 13 is downstream with respect to the region E2 of the recording medium 5. Namely, the region E1 is advanced by one pass with respect to the region E2. As shown in the right portion of FIG. 13, about 87.5% of all of the amount of the light magenta ink (seventh image dot group P2) is ejected from the seventh process color downstream nozzle array 102*b* toward the region E1. In the region E1, the "second printing layer" has been provided over the "first printing layer". With this ejection to provide the "second printing layer", the printing on the region E1 is finished. As described above with reference to FIG. 5 and FIG. 6, the above-described process is continued while the recording medium 5 is sequentially fed forward (F). Therefore, at the pass next to the point in time shown in FIG. 13, the printing on the region E2 is finished. This is applicable to the other colors of process color ink. In this manner, the "overlapping printing" is continuously performed by the printer 10 including the nozzles located as shown in FIG. 12.

In the case of the "second overlapping printing", the nozzles on the upstream side and the nozzles on the downstream side are opposite to those in the "first overlapping printing". More specifically, in the "second overlapping printing", the nozzles 101 of the seventh process color upstream nozzle array 102*a* eject the process color ink for the seventh image dot group P2. The nozzles 111 of the special color downstream nozzle array 112*b* eject the special color ink Sp. The nozzles 101 of the seventh process color downstream nozzle array 102*b* eject the process color ink for the seventh underlying layer dot group P1. This is also applicable to the process color ink heads other than the seventh process color ink head 100, namely, the process color ink heads 40 through 90.

In the case in which an odd number of sub ink heads are provided in an ink head and, thus, the sub ink heads are not equally divided into two, one of the sub ink heads may not be used, for example. The sub ink head not to be used may be the sub ink head located at the end on the upstream side X1, or on the downstream side X2, in the feeding direction X among the sub ink heads included in the ink head. Alternatively, the nozzles in the sub ink head through which the border line, equally dividing the nozzle array into two in the feeding direction X, passes may be divided by the border line into two, namely, into the nozzle(s) on the upstream side X1 and the nozzle(s) on the downstream side X2.

The ink heads in the carriage 25 may be disposed in a different positional arrangement. For example, in the carriage 25, the process color ink heads and the special color ink head may be located as being offset in the feeding direction X. In the case in which the process color ink heads and the special color ink head are located as being completely offset in the feeding direction X, the nozzle array in each ink head are not divided into the upstream nozzle array and the downstream nozzle array. In this case, all of the nozzles in the ink head are usable. In the case in which the process color ink heads and the special color ink head are located as being partially offset in the feeding direction X, the number of the usable nozzles are smaller than in the case in which the ink heads are located as being completely offset, but the carriage 25 may be made more compact. Alternatively, the process color ink heads and the special color ink head may be mounted on, and may be movable by, different carriages. Still alternatively, the printing of the "first printing layer" and the printing of the "second printing layer" may be performed in completely different steps.

In the above-described preferred embodiments, the ink is preferably ejected by a piezo-driving system of changing the volume of the pressure chamber by the displacement of the piezoelectric element. Alternatively, the printer in a preferred embodiment of the present invention may use, for example, any of continuous systems including such as a binary deflection system, a continuous deflection system and other suitable systems, or any of on-demand systems including a thermal system and other systems. There is no limitation on the ink ejection system of the technology disclosed herein.

In the above-described preferred embodiments, the carriage 25 moves in the scanning direction Y whereas the recording medium 5 moves in the feeding direction X. The printer in a preferred embodiment of the present invention is not limited to such a system. The movement of the carriage 25 and the recording medium 5 are relative, and either one of the carriage 25 and the recording medium 5 may be moved in the scanning direction Y or the feeding direction X. For example, the recording medium 5 may be unmovable whereas the carriage 25 may be movable in both of the scanning direction X and the feeding direction X. Alternatively, both of the carriage 25 and the recording medium 5 may be movable in both of the directions.

The technology disclosed herein is applicable to any of various types of inkjet printer. The technology disclosed herein is applicable to a roll-to-roll printer of feeding the roll recording medium 5 described in the above-described preferred embodiments, or to a flat bed inkjet printer. The printer 10 is not limited to a printer that is independently usable, and may be a printer that is combinable with another device. For example, the printer 10 may be incorporated into another device.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The terms and expressions used herein are for description purposes only and are not to be interpreted in a limited sense. These terms and expressions should be recognized as not excluding any equivalents to the elements shown and described herein and as allowing any modification encompassed in the scope of the claims. The present invention may be embodied in many various configurations. This disclosure should be regarded as providing preferred embodiments of the principles of the present invention. These preferred embodiments are provided with the understanding that they are not intended to limit the present invention to the preferred embodiments described in the specification and/or shown in the drawings. The present invention is not limited to the preferred embodiments and modifications described herein. The present invention encompasses any of preferred embodiments including equivalent elements, modifications, deletions, combinations, improvements, and/or alterations which may be recognized by a person of ordinary skill in the art based on the disclosure. The elements of each claim should be interpreted broadly based on the terms used in the claim, and should not be limited to any of the preferred embodiments described in this specification or used during the prosecution of the present application.

What is claimed is:

1. An inkjet printer, comprising:

a plurality of ink heads including:

a first color ink head including a plurality of nozzles through which a first ink of a first color is ejected towards a recording medium to form ink dots of the first ink of the first color on the recording medium;

a second color ink head including a plurality of nozzles through which a first ink of a second color is ejected towards the recording medium to form ink dots of the first ink of the second color on the recording medium; and a second ink ink head including a plurality of nozzles through which a second ink is ejected towards the recording medium to form ink dots of the second ink on the recording medium;

a moving mechanism to move the plurality of ink heads and the recording medium with respect to each other; and a controller connected with the plurality of ink heads and the moving mechanism to control the plurality of ink heads and the moving mechanism; wherein the controller includes:

a first generator to generate, upon receipt of data on the ink dots of the first ink of the first color, a plurality of first dot groups, including a first underlying layer dot group and a first image dot group, of the ink dots of the first ink of the first color;

a second generator to generate, upon receipt of data on the ink dots of the first ink of the second color, a plurality of second dot groups, including a second underlying layer dot group and a second image dot group, of the ink dots of the first ink of the second color;

a first printing controller to form a first printing layer, on the recording medium, of at least the ink dots of the first underlying layer dot group, the ink dots of the second underlying layer dot group, and the ink dots of the second ink;

a second printing controller to form a second printing layer, above or below the first printing layer, of at least the ink dots of the first image dot group and the ink dots of the second image dot group;

a first ratio setter to set a ratio of the ink dots of each of the plurality of first dot groups with respect to the ink dots of the first ink of the first color; and a second ratio setter to set a ratio of the ink dots of each of the plurality of second dot groups with respect to the ink dots of the first ink of the second color; wherein the first generator generates the plurality of first dot groups such that the plurality of first dot groups include all of the ink dots of the first ink of the first color; and the second generator generates the plurality of second dot groups such that the plurality of second dot groups include all of the ink dots of the first ink of the second color;

the first generator generates each of the plurality of first dot groups such that the ratio of each of the plurality of first dot groups with respect to the ink dots of the first ink of the first color is the same or substantially the same as the ratio set by the first ratio setter;

the second generator generates each of the plurality of second dot groups such that the ratio of each of the plurality of second dot groups with respect to the ink dots of the first ink of the second color is the same or substantially the same as the ratio set by the second ratio setter;

the first ink of the first color has a first color developing property;

the first ink of the second color has a second color developing property different from the first color developing property; and the first ratio setter and the second ratio setter:

in a case in which the first color developing property is lower than the second color developing property, set the ratio of the first underlying layer dot group with respect to the ink dots of the first ink of the first color to be higher than the ratio of the second underlying layer dot group with respect to the ink dots of the first ink of the second color; and in a case in which the second color developing property is lower than the first color developing property, set the ratio of the second underlying layer dot group with respect to the ink dots of the first ink of the second color to be higher than the ratio of the first underlying layer dot group with respect to the ink dots of the first ink of the first color.

2. The inkjet printer according to claim 1, wherein the first ink of the first color is a first process color ink;

the first ink of the second color is a second process color ink different from the first process color ink; and the second ink is a special color ink.

3. The inkjet printer according to claim 1, wherein the first ink of the first color includes a color material at a first ratio;

the first ink of the second color includes a color material at a second ratio different from the first ratio; and the first ratio setter and the second ratio setter:

in a case in which the first ratio is lower than the second ratio, set the ratio of the first underlying layer dot group with respect to the ink dots of the first ink of the first color to be higher than the ratio of the second underlying layer dot group with respect to the ink dots of the first ink of the second color; and in a case in which the second ratio is lower than the first ratio, set the ratio of the second underlying layer dot group with respect to the ink dots of the first ink of the second color to be higher than the ratio of the first underlying layer dot group with respect to the ink dots of the first ink of the first color.

4. The inkjet printer according to claim 1, wherein the controller includes a mode selector to select any one of a plurality of printing modes including a first printing mode of forming the first printing layer below the second printing layer and a second printing mode of forming the first printing layer above the second printing layer.

5. The inkjet printer according to claim 1, wherein the first color ink head includes first color actuators causing the first ink of the first color to be ejected from the nozzles;

the second color ink head includes second color actuators causing the first ink of the second color to be ejected from the nozzles;

the second ink ink head includes a second ink actuators causing the second ink to be ejected from the nozzles;

the controller includes:

a first color size controller to control the first color actuators such that a dot size of the first underlying layer dot group is a first size;

a second color size controller to control the second color actuators such that a dot size of the second underlying layer dot group is a second size; and a second ink size controller to control the second ink actuators such that a dot size of the second ink is a third size;

the first size, the second size, and the third size are equal or substantially equal to each other;

the first color size controller, the second color size controller, and the second ink size controller each select a dot size from a plurality of predefined dot sizes; and the first size, the second size, and the third size are smallest among the plurality of predefined dot sizes.

6. The inkjet printer according to claim 1, wherein the first color ink head includes first color actuators causing the first ink of the first color to be ejected from the nozzles;

the second color ink head includes second color actuators causing the first ink of the second color to be elected from the nozzles;

the second ink ink head includes a second ink actuators causing the second ink to be elected from the nozzles; and the controller includes:

a first color size controller to control the first color actuators such that a dot size of the first underlying layer dot group is a first size;

a second color size controller to control the second color actuators such that a dot size of the second underlying layer dot group is a second size;

a second ink size controller to control the second ink actuators such that a dot size of the second ink is a third size;

a first color size input portion connected with the first color size controller, the first size being input to the first color size input portion;

a second color size input portion connected with the second color size controller, the second size being input to the second color size input portion; and a second ink size input portion connected with the second ink size controller, the third size being input to the second ink size input portion.

7. The inkjet printer according to claim 1, wherein the moving mechanism includes a feeding mechanism feeding the recording medium;

the first color ink head, the second color ink head, and the second ink ink head are located side by side in a scanning direction perpendicular or substantially perpendicular to a feeding direction in which the recording medium is fed;

the first color ink head includes:

a first color upstream nozzle array including a portion of the plurality of nozzles arrayed in the feeding direction; and a first color downstream nozzle array including another portion of the plurality of nozzles arrayed in the feeding direction, the first color downstream nozzle array being located downstream with respect to the first color upstream nozzle array in the feeding direction;

the second color ink head includes:

a second color upstream nozzle array including a portion of the plurality of nozzles arrayed in the feeding direction; and a second color downstream nozzle array including another portion of the plurality of nozzles arrayed in the feeding direction, the second color downstream nozzle array being located downstream with respect to the second color upstream nozzle array in the feeding direction;

the second ink ink head includes;

a second ink upstream nozzle array including a portion of the plurality of nozzles arrayed in the feeding direction; and a second ink downstream nozzle array including another portion of the plurality of nozzles arrayed in the feeding direction, the second ink downstream nozzle array being located downstream with respect to the second ink upstream nozzle array in the feeding direction;

the first printing controller:

in a case in which the first printing layer is to be provided below the second printing layer, causes the nozzles of the first color upstream nozzle array to eject the first ink of the first color that provides the first underlying layer dot group, causes the nozzles of the second color upstream nozzle array to eject the first ink of the second color that forms the second underlying layer dot group, and causes the nozzles of the second ink upstream nozzle array to eject the second ink, to provide the first printing layer; and in a case in which the first printing layer is to be provided above the second printing layer, causes the nozzles of the first color downstream nozzle array to eject the first ink of the first color that forms the first underlying layer dot group, causes the nozzles of the second color downstream nozzle array to eject the first ink of the second color forms the second underlying layer dot group, and causes the nozzles of the second ink downstream nozzle array to eject the second ink, to form the first printing layer; and the second printing controller:

in a case in which the first printing layer is to be formed below the second printing layer, causes the nozzles of the first color downstream nozzle array to eject the first ink of the first color that forms the first image dot group, and causes the nozzles of the second color downstream nozzle array to eject the first ink of the second color that forms the second image dot group, to form the second printing layer; and in a case in which the first printing layer is to be formed above the second printing layer, causes the nozzles of the first color upstream nozzle array to eject the first ink of the first color that forms the first image dot group, and causes the nozzles of the second color upstream nozzle array to eject the first ink of the second color that forms the second image dot group, to form the second printing layer.

8. An inkjet printer, comprising:

a plurality of ink heads including:

a first color ink head including a plurality of nozzles through which a first ink of a first color is ejected towards a recording medium to form ink dots of the first ink of the first color on the recording medium;

a second color ink head including a plurality of nozzles through which a first ink of a second color is ejected towards the recording medium to form ink dots of the first ink of the second color on the recording medium; and a second ink ink head including a plurality of nozzles through which a second ink is ejected towards the recording medium to form ink dots of the second ink on the recording medium;

a moving mechanism to move the plurality of ink heads and the recording medium with respect to each other; and a controller connected with the plurality of ink heads and the moving mechanism to control the plurality of ink heads and the moving mechanism; wherein the controller includes:

a first generator to generate, upon receipt of data on the ink dots of the first ink of the first color, a plurality of first dot groups, including a first underlying layer dot group and a first image dot group, of the ink dots of the first ink of the first color;

a second generator to generate, upon receipt of data on the ink dots of the first ink of the second color, a plurality of second dot groups, including a second underlying layer dot group and a second image dot group, of the ink dots of the first ink of the second color;

a first printing controller to form a first printing layer, on the recording medium, of at least the ink dots of the first underlying layer dot group, the ink dots of the second underlying layer dot group, and the ink dots of the second ink;

a second printing controller to form a second printing layer, above or below the first printing layer, of at least the ink dots of the first image dot group and the ink dots of the second image dot group;

a first ratio setter to set a ratio of the ink dots of each of the plurality of first dot groups with respect to the ink dots of the first ink of the first color; and a second ratio setter to set a ratio of the ink dots of each of the plurality of second dot groups with respect to the ink dots of the first ink of the second color;

wherein the first generator generates the plurality of first dot groups such that the plurality of first dot groups include all of the ink dots of the first ink of the first color; and the second generator generates the plurality of second dot groups such that the plurality of second dot groups include all of the ink dots of the first ink of the second color;

the first generator generates each of the plurality of first dot groups such that the ratio of each of the plurality of first dot groups with respect to the ink dots of the first ink of the first color is the same or substantially the same as the ratio set by the first ratio setter;

the second generator generates each of the plurality of second dot groups such that the ratio of each of the plurality of second dot groups with respect to the ink dots of the first ink of the second color is the same or substantially the same as the ratio set by the second ratio setter;

the first ink of the first color has a first brightness;

the first ink of the second color has a second brightness different from the first brightness; and the first ratio setter and the second ratio setter:

in a case in which the first brightness is higher than the second brightness, set the ratio of the first underlying layer dot group with respect to the ink dots of the first ink of the first color to be higher than the ratio of the second underlying layer dot group with respect to the ink dots of the first ink of the second color; and in a case in which the second brightness is higher than the first brightness, set the ratio of the second underlying layer dot group with respect to the ink dots of the first ink of the second color to be higher than the ratio of the first underlying layer dot group with respect to the ink dots of the first ink of the first color.

9. The inkjet printer according to claim 8, wherein the first ink of the first color is a first process color ink;

the first ink of the second color is a second process color ink different from the first process color ink; and the second ink is a special color ink.

10. The inkjet printer according to claim 8, wherein the controller includes a mode selector to select any one of a plurality of printing modes including a first printing mode of forming the first printing layer below the second printing layer and a second printing mode of forming the first printing layer above the second printing layer.

11. The inkjet printer according to claim 8, wherein the first color ink head includes first color actuators causing the first ink of the first color to be ejected from the nozzles;

the second color ink head includes second color actuators causing the first ink of the second color to be ejected from the nozzles;

the second ink ink head includes a second ink actuators causing the second ink to be ejected from the nozzles;

the controller includes:

a first color size controller to control the first color actuators such that a dot size of the first underlying layer dot group is a first size;

a second color size controller to control the second color actuators such that a dot size of the second underlying layer dot group is a second size; and a second ink size controller to control the second ink actuators such that a dot size of the second ink is a third size;

the first size, the second size, and the third size are equal or substantially equal to each other;

the first color size controller, the second color size controller, and the second ink size controller each select a dot size from a plurality of predefined dot sizes; and the first size, the second size, and the third size are smallest among the plurality of predefined dot sizes.

12. The inkjet printer according to claim 8, wherein the first color ink head includes first color actuators causing the first ink of the first color to be ejected from the nozzles;

the second color ink head includes second color actuators causing the first ink of the second color to be ejected from the nozzles;

the second ink ink head includes a second ink actuators causing the second ink to be ejected from the nozzles; and the controller includes:

a first color size controller to control the first color actuators such that a dot size of the first underlying layer dot group is a first size;

a second color size controller to control the second color actuators such that a dot size of the second underlying layer dot group is a second size;

a second ink size controller to control the second ink actuators such that a dot size of the second ink is a third size;

a first color size input portion connected with the first color size controller, the first size being input to the first color size input portion;

a second color size input portion connected with the second color size controller, the second size being input to the second color size input portion; and a second ink size input portion connected with the second ink size controller, the third size being input to the second ink size input portion.

13. The inkjet printer according to claim 8, wherein the moving mechanism includes a feeding mechanism feeding the recording medium;

the first color ink head, the second color ink head, and the second ink ink head are located side by side in a scanning direction perpendicular or substantially perpendicular to a feeding direction in which the recording medium is fed;

the first color ink head includes:

a first color upstream nozzle array including a portion of the plurality of nozzles arrayed in the feeding direction; and a first color downstream nozzle array including another portion of the plurality of nozzles arrayed in the feeding direction, the first color downstream nozzle array being located downstream with respect to the first color upstream nozzle array in the feeding direction;

the second color ink head includes:

a second color upstream nozzle array including a portion of the plurality of nozzles arrayed in the feeding direction; and a second color downstream nozzle array including another portion of the plurality of nozzles arrayed in the feeding direction, the second color downstream nozzle array being located downstream with respect to the second color upstream nozzle array in the feeding direction;

the second ink ink head includes;

a second ink upstream nozzle array including a portion of the plurality of nozzles arrayed in the feeding direction; and a second ink downstream nozzle array including another portion of the plurality of nozzles arrayed in the feeding direction, the second ink downstream nozzle array being located downstream with respect to the second ink upstream nozzle array in the feeding direction;

the first printing controller:

in a case in which the first printing layer is to be provided below the second printing layer, causes the nozzles of the first color upstream nozzle array to eject the first ink of the first color that provides the first underlying layer dot group, causes the nozzles of the second color upstream nozzle array to eject the first ink of the second color that forms the second underlying layer dot group, and causes the nozzles of the second ink upstream nozzle array to eject the second ink, to provide the first printing layer; and in a case in which the first printing layer is to be provided above the second printing layer, causes the nozzles of the first color downstream nozzle array to eject the first ink of the first color that forms the first underlying layer dot group, causes the nozzles of the second color downstream nozzle array to eject the first ink of the second color forms the second underlying layer dot group, and causes the nozzles of the second ink downstream nozzle array to eject the second ink, to form the first printing layer; and the second printing controller:

in a case in which the first printing layer is to be formed below the second printing layer, causes the nozzles of the first color downstream nozzle array to eject the first ink of the first color that forms the first image dot group, and causes the nozzles of the second color downstream nozzle array to eject the first ink of the second color that forms the second image dot group, to form the second printing layer; and in a case in which the first printing layer is to be formed above the second printing layer, causes the nozzles of the first color upstream nozzle array to eject the first ink of the first color that forms the first image dot group, and causes the nozzles of the second color upstream nozzle array to eject the first ink of the second color that forms the second image dot group, to form the second printing layer.

14. An inkjet printer, a plurality of ink heads including:

a first color ink head including a plurality of nozzles through which a first ink of a first color is ejected towards a recording medium to form ink dots of the first ink of the first color on the recording medium;

a second color ink head including a plurality of nozzles through which a first ink of a second color is ejected towards the recording medium to form ink dots of the first ink of the second color on the recording medium; and a second ink ink head including a plurality of nozzles through which a second ink is ejected towards the recording medium to form ink dots of the second ink on the recording medium;

a moving mechanism to move the plurality of ink heads and the recording medium with respect to each other; and a controller connected with the plurality of ink heads and the moving mechanism to control the plurality of ink heads and the moving mechanism; wherein the controller includes:

a first generator to generate, upon receipt of data on the ink dots of the first ink of the first color, a plurality of first dot groups, including a first underlying layer dot group and a first image dot group, of the ink dots of the first ink of the first color;

a second generator to generate, upon receipt of data on the ink dots of the first ink of the second color, a plurality of second dot groups, including a second underlying layer dot group and a second image dot group, of the ink dots of the first ink of the second color;

a first printing controller to form a first printing layer, on the recording medium, of at least the ink dots of the first underlying layer dot group, the ink dots of the second underlying layer dot group, and the ink dots of the second ink;

a second printing controller to form a second printing layer, above or below the first printing layer, of at least the ink dots of the first image dot group and the ink dots of the second image dot group;

a first ratio setter to set a ratio of the ink dots of each of the plurality of first dot groups with respect to the ink dots of the first ink of the first color; and a second ratio setter to set a ratio of the ink dots of each of the plurality of second dot groups with respect to the ink dots of the first ink of the second color;

wherein the first generator generates the plurality of first dot groups such that the plurality of first dot groups include all of the ink dots of the first ink of the first color; and the second generator generates the plurality of second dot groups such that the plurality of second dot groups include all of the ink dots of the first ink of the second color;

the first generator generates each of the plurality of first dot groups such that the ratio of each of the plurality of first dot groups with respect to the ink dots of the first ink of the first color is the same or substantially the same as the ratio set by the first ratio setter;

the second generator generates each of the plurality of second dot groups such that the ratio of each of the plurality of second dot groups with respect to the ink dots of the first ink of the second color is the same or substantially the same as the ratio set by the second ratio setter;

the first ink of the first color has a first wettability for the recording medium;

the first ink of the second color has a second wettability different from the first wettability for the recording medium; and the first ratio setter and the second ratio setter:

in a case in which the first wettability is lower than the second wettability, set the ratio of the first underlying layer dot group with respect to the ink dots of the first ink of the first color to be higher than the ratio of the second underlying layer dot group with respect to the ink dots of the first ink of the second color; and in a case in which the second wettability is lower than the first wettability, set the ratio of the second underlying layer dot group with respect to the ink dots of the first ink of the second color to be higher than the ratio of the first underlying layer dot group with respect to the ink dots of the first ink of the first color.

15. The inkjet printer according to claim 14, wherein the first ink of the first color is a first process color ink;

the first ink of the second color is a second process color ink different from the first process color ink; and the second ink is a special color ink.

16. The inkjet printer according to claim 14, wherein the controller includes a mode selector to select any one of a plurality of printing modes including a first printing mode of forming the first printing layer below the second printing layer and a second printing mode of forming the first printing layer above the second printing layer.

17. The inkjet printer according to claim 14, wherein the first color ink head includes first color actuators causing the first ink of the first color to be ejected from the nozzles;

the second color ink head includes second color actuators causing the first ink of the second color to be ejected from the nozzles;

the second ink ink head includes a second ink actuators causing the second ink to be ejected from the nozzles;

the controller includes:

a first color size controller to control the first color actuators such that a dot size of the first underlying layer dot group is a first size;

a second color size controller to control the second color actuators such that a dot size of the second underlying layer dot group is a second size; and a second ink size controller to control the second ink actuators such that a dot size of the second ink is a third size;

the first size, the second size, and the third size are equal or substantially equal to each other;

the first color size controller, the second color size controller, and the second ink size controller each select a dot size from a plurality of predefined dot sizes; and the first size, the second size, and the third size are smallest among the plurality of predefined dot sizes.

18. The inkjet printer according to claim 14, wherein the first color ink head includes first color actuators causing the first ink of the first color to be ejected from the nozzles;

the second color ink head includes second color actuators causing the first ink of the second color to be ejected from the nozzles;

the second ink ink head includes a second ink actuators causing the second ink to be ejected from the nozzles; and the controller includes:

a first color size controller to control the first color actuators such that a dot size of the first underlying layer dot group is a first size;

a second color size controller to control the second color actuators such that a dot size of the second underlying layer dot group is a second size;

a second ink size controller to control the second ink actuators such that a dot size of the second ink is a third size;

a first color size input portion connected with the first color size controller, the first size being input to the first color size input portion;

a second color size input portion connected with the second color size controller, the second size being input to the second color size input portion; and a second ink size input portion connected with the second ink size controller, the third size being input to the second ink size input portion.

19. The inkjet printer according to claim 14, wherein the moving mechanism includes a feeding mechanism feeding the recording medium;

the first color ink head, the second color ink head, and the second ink ink head are located side by side in a scanning direction perpendicular or substantially perpendicular to a feeding direction in which the recording medium is fed;

the first color ink head includes:

a first color upstream nozzle array including a portion of the plurality of nozzles arrayed in the feeding direction; and a first color downstream nozzle array including another portion of the plurality of nozzles arrayed in the feeding direction, the first color downstream nozzle array being located downstream with respect to the first color upstream nozzle array in the feeding direction;

the second color ink head includes:

a second color upstream nozzle array including a portion of the plurality of nozzles arrayed in the feeding direction; and a second color downstream nozzle array including another portion of the plurality of nozzles arrayed in the feeding direction, the second color downstream nozzle array being located downstream with respect to the second color upstream nozzle array in the feeding direction;

the second ink ink head includes;

a second ink upstream nozzle array including a portion of the plurality of nozzles arrayed in the feeding direction; and a second ink downstream nozzle array including another portion of the plurality of nozzles arrayed in the feeding direction, the second ink downstream nozzle array being located downstream with respect to the second ink upstream nozzle array in the feeding direction;

the first printing controller:

in a case in which the first printing layer is to be provided below the second printing layer, causes the nozzles of the first color upstream nozzle array to eject the first ink of the first color that provides the first underlying layer dot group, causes the nozzles of the second color upstream nozzle array to eject the first ink of the second color that forms the second underlying layer dot group, and causes the nozzles of the second ink upstream nozzle array to eject the second ink, to provide the first printing layer; and in a case in which the first printing layer is to be provided above the second printing layer, causes the nozzles of the first color downstream nozzle array to eject the first ink of the first color that forms the first underlying layer dot group, causes the nozzles of the second color downstream nozzle array to eject the first ink of the second color forms the second underlying layer dot group, and causes the nozzles of the second ink downstream nozzle array to eject the second ink, to form the first printing layer; and the second printing controller:

in a case in which the first printing layer is to be formed below the second printing layer, causes the nozzles of the first color downstream nozzle array to eject the first ink of the first color that forms the first image dot group, and causes the nozzles of the second color downstream nozzle array to eject the first ink of the second color that forms the second image dot group, to form the second printing layer; and in a case in which the first printing layer is to be formed above the second printing layer, causes the nozzles of the first color upstream nozzle array to eject the first ink of the first color that forms the first image dot group, and causes the nozzles of the second color upstream nozzle array to eject the first ink of the second color that forms the second image dot group, to form the second printing layer.

* * * * *